US010295919B2

(12) United States Patent
Makabe et al.

(10) Patent No.: US 10,295,919 B2
(45) Date of Patent: May 21, 2019

(54) TONER, DEVELOPER, TONER STORAGE UNIT, AND IMAGE FORMING APPARATUS

(71) Applicants: Keiji Makabe, Shizuoka (JP); Tsuneyasu Nagatomo, Shizuoka (JP); Kohsuke Satoh, Shizuoka (JP); Kenji Yoneda, Osaka (JP)

(72) Inventors: Keiji Makabe, Shizuoka (JP); Tsuneyasu Nagatomo, Shizuoka (JP); Kohsuke Satoh, Shizuoka (JP); Kenji Yoneda, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/846,568

(22) Filed: Dec. 19, 2017

(65) Prior Publication Data

US 2018/0181014 A1 Jun. 28, 2018

(30) Foreign Application Priority Data

Dec. 22, 2016 (JP) ..... 2016-248999

(51) Int. Cl.
*G03G 9/08* (2006.01)
*G03G 9/097* (2006.01)
(Continued)

(52) U.S. Cl.
CPC ..... *G03G 9/0825* (2013.01); *G03G 9/0819* (2013.01); *G03G 9/0827* (2013.01); *G03G 9/08711* (2013.01); *G03G 9/08755* (2013.01); *G03G 9/0904* (2013.01); *G03G 9/097* (2013.01); *G03G 9/09716* (2013.01); *G03G 9/09725* (2013.01); *G03G 15/0865* (2013.01)

(58) Field of Classification Search
CPC ..... G03G 9/0825; G03G 9/08755; G03G 9/08711; G03G 9/0827; G03G 9/0819; G03G 9/0904; G03G 15/0865
See application file for complete search history.

(56) References Cited

U.S. PATENT DOCUMENTS

2007/0054210 A1* 3/2007 Ohki ..... G03G 9/0804 430/108.21
2007/0275315 A1 11/2007 Nagatomo et al.
(Continued)

FOREIGN PATENT DOCUMENTS

JP 2006-206414 8/2006
JP 2010-055117 3/2010
(Continued)

*Primary Examiner* — Thorl Chea
(74) *Attorney, Agent, or Firm* — Oblon, McClelland, Maier & Neustadt, L.L.P.

(57) ABSTRACT

A toner is provided. The toner includes toner particles each including a mother particle and external additive particles covering the mother particle. In a SEM image of the toner, toner particles having a ratio Sd/St of from 5% to 50% are present at a frequency of 15% or more, where Sd representing an area of a largest recessed portion D of each toner particle and St representing whole area of the toner particle, Sd and St determined from the SEM image magnified and binarized to discriminate recessed portions and projected portions of the toner particle from each other. An external additive coverage rate Ca at the largest recessed portion D is from 30% to 100%.

7 Claims, 11 Drawing Sheets

(51) Int. Cl.

| | |
|---|---|
| ***G03G 9/09*** | (2006.01) |
| ***G03G 9/087*** | (2006.01) |
| *G03G 15/08* | (2006.01) |

(56) References Cited

U.S. PATENT DOCUMENTS

| | | | | |
|---|---|---|---|---|
| 2008/0233505 | A1* | 9/2008 | Nagatomo ..... | G03G 9/0806<br>430/108.6 |
| 2009/0067876 | A1 | 3/2009 | Seshita et al. | |
| 2009/0142094 | A1 | 6/2009 | Sawada et al. | |
| 2010/0119255 | A1 | 5/2010 | Seshita et al. | |
| 2016/0266507 | A1 | 9/2016 | Watanabe et al. | |
| 2016/0334722 | A1 | 11/2016 | Makabe et al. | |

FOREIGN PATENT DOCUMENTS

| | | |
|---|---|---|
| JP | 2010-244033 | 10/2010 |
| JP | 2011-107366 | 6/2011 |

* cited by examiner

TONER, DEVELOPER, TONER STORAGE UNIT, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2016-248999, filed on Dec. 22, 2016, in the Japan Patent Office, the entire disclosure of which is hereby incorporated by reference herein.

BACKGROUND

Technical Field

The present disclosure relates to a toner, a developer, a toner storage unit, and an image forming apparatus.

Description of the Related Art

A typical image forming apparatus forms an image on a print sheet through the following processes: a charging process in which an image forming area on a surface of an image bearer is uniformly charged; an irradiation process in which a latent image is written on the image bearer; a developing process in which the latent image is developed into a visible image with a triboelectrically-charged toner; and a transfer process in which the image is transferred onto the print sheet either directly or indirectly via an intermediate transferor. After residual toner particles remaining on the image bearer without being transferred are removed in a cleaning process, next image forming process starts.

Demand for high-quality full-color image forming technology is increasing these days. In response to such demand, toner is now required to be much smaller in size for improved thin line reproducibility.

However, small toner particles disadvantageously increase non-electrostatic adhesive force to an electrophotographic photoconductor or intermediate transferor, thus causing hollow defect at thin line portions of the resulting image and/or a decrease of transfer efficiency in the transfer process.

To overcome such a drawback, it has been proposed that toner particles be more spherical in shape, by suppressing the occurrence of micro uneven structure, to decrease the contact area and suppress embedding or rolling of external additives.

However, there arises a problem that the more spherical the toner particles become, the more easily the toner particles pass through a damming member in the cleaning process, thus degrading cleanability. To solve this problem, a technique for improving cleanability has been proposed by making the toner shape irregular and suppressing the irregular-shaped toner particles from passing through the damming member. In view of the above situation, the toner shape is generally designed so as to satisfy both transferability and cleanability in a good balance.

However, even with the toner shape satisfying both transferability and cleanability, it is difficult to achieve stable transferability on sheets with large surface unevenness, although high-quality printing technology on such sheets with large surface unevenness has been demanded recently. In particular, in a situation in which the adhesive force of toner is increased, for example, in a high-temperature high-humidity environment or in a case in which the toner is deteriorated, problems notably occur.

SUMMARY

In accordance with some embodiments of the present invention, a toner is provided. The toner includes toner particles each including a mother particle and external additive particles covering the mother particle. In a SEM image of the toner, toner particles having a ratio Sd/St of from 5% to 50% are present at a frequency of 15% or more, where Sd representing an area of a largest recessed portion D of each toner particle and St representing whole area of the toner particle, Sd and St determined from the SEM image magnified and binarized to discriminate recessed portions and projected portions of the toner particle from each other. An external additive coverage rate Ca at the largest recessed portion D is from 30% to 100%.

In accordance with some embodiments of the present invention, a developer is provided. The developer includes the above toner and a carrier.

In accordance with some embodiments of the present invention, a toner storage unit is provided. The toner storage unit includes a container and the above toner stored in the container.

In accordance with some embodiments of the present invention, an image forming apparatus is provided. The image forming apparatus includes a photoconductor, a charger to charge the photoconductor, an irradiator to irradiate the charged photoconductor with light to form an electrostatic latent image thereon, and a developing device including the above toner, configured to develop the electrostatic latent image into a toner image with the toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
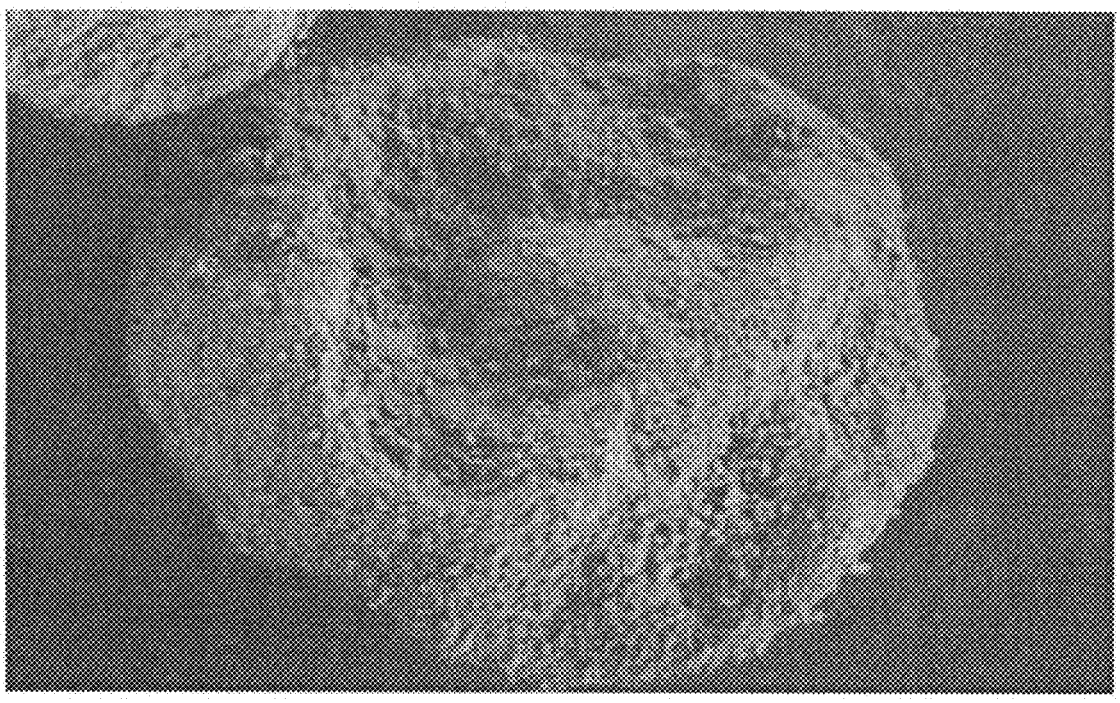
FIG. 1 is an SEM (scanning electron microscope) image of a toner particle in accordance with some embodiments of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner is provided which can maintain stable transferability onto a sheet having large surface unevenness even after a long-term use regardless of the hygrothermal environment.

Incidentally, it is to be noted that the following embodiments are not limiting the present disclosure and any deletion, addition, modification, change, etc. can be made within a scope in which man in the art can conceive including other embodiments, and any of which is included within the scope of the present disclosure as long as the effect and feature of the present disclosure are demonstrated.

Toner

A toner in accordance with some embodiments of the present invention comprises toner particles each comprising a mother particle and external additive particles covering the mother particle. In a SEM image of the toner, toner particles having a ratio Sd/St of from 5% to 50% are present at a frequency of 15% or more, where Sd representing an area of a largest recessed portion D of each toner particle and St representing whole area of the toner particle. Sd and St are determined from the SEM image magnified and binarized to discriminate recessed portions and projected portions of the toner particle from each other. An external additive coverage rate Ca at the largest recessed portion D is from 30% to 100%.

FIG. 1 is an SEM (scanning electron microscope) image of a toner particle in accordance with some embodiments of the present invention. The toner particle comprises a mother particle covered with external additive particles. The surface of the mother particle, even at recessed portions, is covered with external additive particles.

In the toner, toner particles having a ratio Sd/St of from 5% to 50% are present at a frequency of 15% or more. The external additive coverage rate Ca at the largest recessed portion D is from 30% to 100%. This indicates that each toner particle has recessed portions and projected portions, with some recessed portions being wide and deep, and even deeply recessed portions are sufficiently covered with the external additive particles.

Such a toner can maintain stable transferability onto a sheet having large surface unevenness by suppressing the occurrence of hollow defect at thin line portions of an image and/or a decrease of transfer efficiency, even after a long-term use regardless of the hygrothermal environment.

Although the details are not clear, the reason for this phenomenon is considered as follows.

One possible cause for the occurrence of hollow defect at thin line portions of an image and/or a decrease of transfer efficiency is a high non-electrostatic adhesive force of toner particles. When toner particles have a high non-electrostatic adhesive force, the non-electrostatic adhesive force between toner particles or that between a toner particle and an image bearer is increased, due to a primary transfer pressure generated when the toner is transferred from the image bearer (e.g., a photoconductor) onto a transferor (e.g., transfer belt) by bringing the image bearer into an intimate contact with the transferor or a secondary transfer pressure generated in an intermediate transfer process. In this case, the attractive force between the toner particle and the image bearer come to exceed the repulsive force of the transfer electric field. As a result, it becomes difficult for the toner particles to separate from the image bearer, thereby causing hollow defect or a decrease of transfer efficiency.

As to the shape of toner, the less the number of contact points becomes, the smaller the non-electrostatic adhesive force becomes. For this reason, spherical toner particles are known to have a small non-electrostatic adhesive force. The toner particles in accordance with some embodiments of the present invention have irregular shape with widely and deeply recessed portions and projected portions. Such toner particles contact the image bearer with a less number of contact points, thus reducing the non-electrostatic adhesive force. On the other hand, the toner particles may contact with each other with a large number of contact points in a case in which the widely and deeply recessed portions and projected portions are fitted to each other. In this case, the non-electrostatic adhesive force may be increased. To avoid such a problem, in the present embodiment, the recessed portions are sufficiently covered with external additive particles to suppress the mother particles from contacting or aggregating with each other.

The area Sd of the largest recessed portion D is determined by counting the number of pixels in the recessed portion D in a SEM image.

More specifically, first, a SEM image of a toner particle is binarized with a threshold determined by a discriminant analysis method (i.e., Otsu's binarization method) so that recessed portions and projected portions of the toner particle are discriminated from each other. Next, pixels which are enclosed by a 0.2-μm concentric square all part of which is discriminated as a recessed portion are all identified. The identified pixels are continuous to form a group. The wider and deeper the recessed portions become, the larger the group becomes. Among multiple groups of the identified pixels, the largest one is identified as the largest recessed portion D.

These operations are preferably performed with an appropriate program for improving efficiency. Sd is determined by converting the area of one pixel depending on the scale of the SEM image. The whole area St of one toner particle is determined by counting the number of pixels in the toner particle in the SEM image.

For determining the area of the recessed portion D, it is preferable that the SEM image is photographed so that the recessed portion D faces the front. In addition, it is preferable to confirm whether or not a much wider or deeper recessed portion exists before binarizing the SEM image of the toner particle to determine the largest recessed portion D.

Figure 2A:
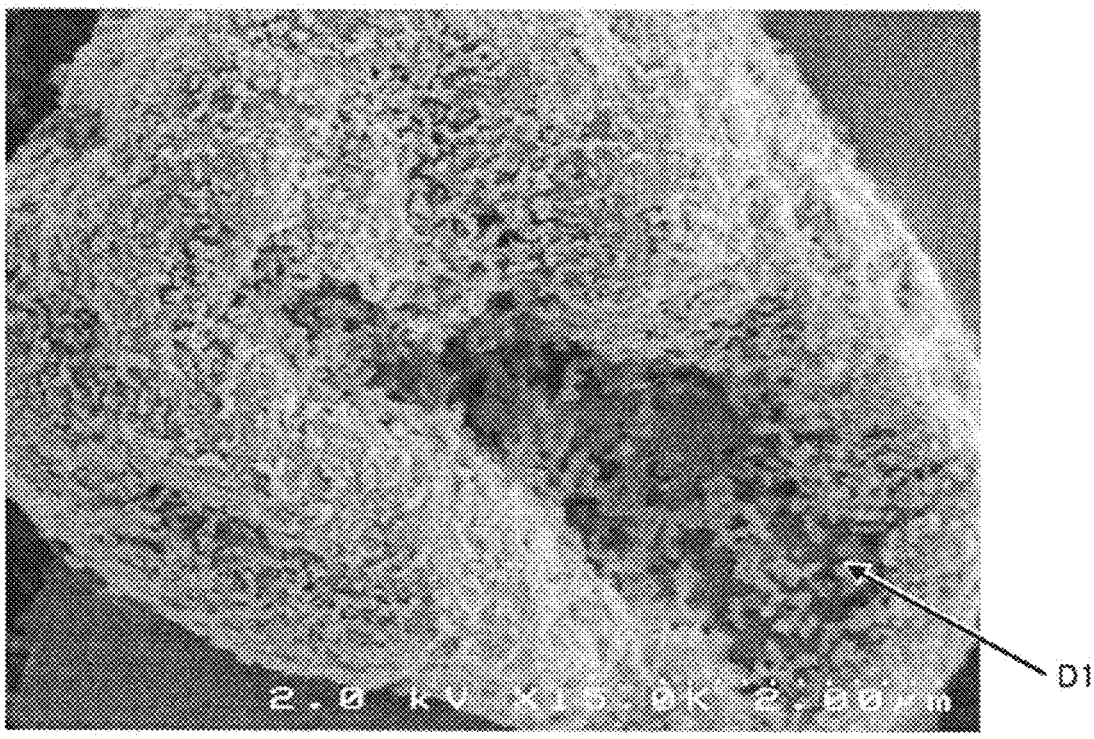
FIG. 2A is a SEM image of a toner particle in accordance with some embodiments of the present invention, having a ratio Sd/St of from 5% to 50%.
Figure 2B:
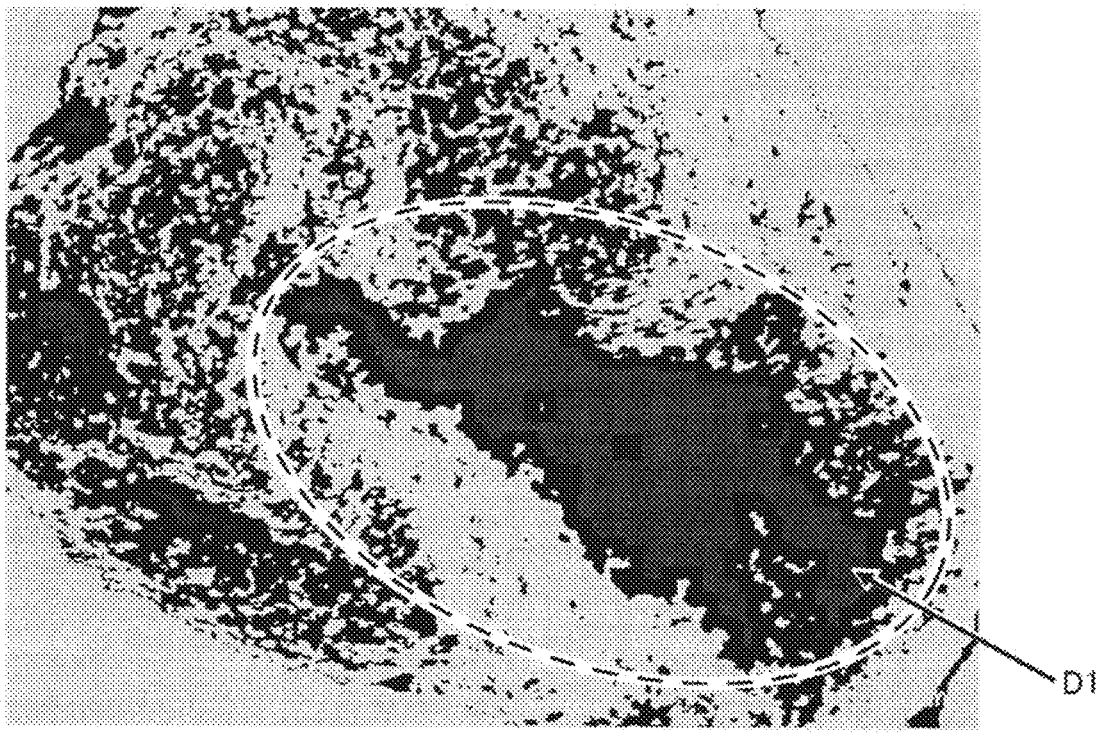
FIG. 2B is a binarized SEM image of FIG. 2A for determining a recessed portion D.

How to determine Sd is explained below with reference to FIGS. 2A-2B and 3A-3B. A toner particle shown in FIGS. 2A and 2B has a ratio Sd/St of from 5% to 50%. FIG. 2A is an original SEM image before being binarized. FIG. 2B is a binarized SEM image obtained by binarizing the original SEM image (FIG. 2A) by the above-described procedure. In FIG. 2B, the largest recessed portion D is denoted as D1 and roughly enclosed by broken lines. The area Sd of D1 is determined from this image, and then Sd/St is determined to be 9.4%.

Figure 3A:
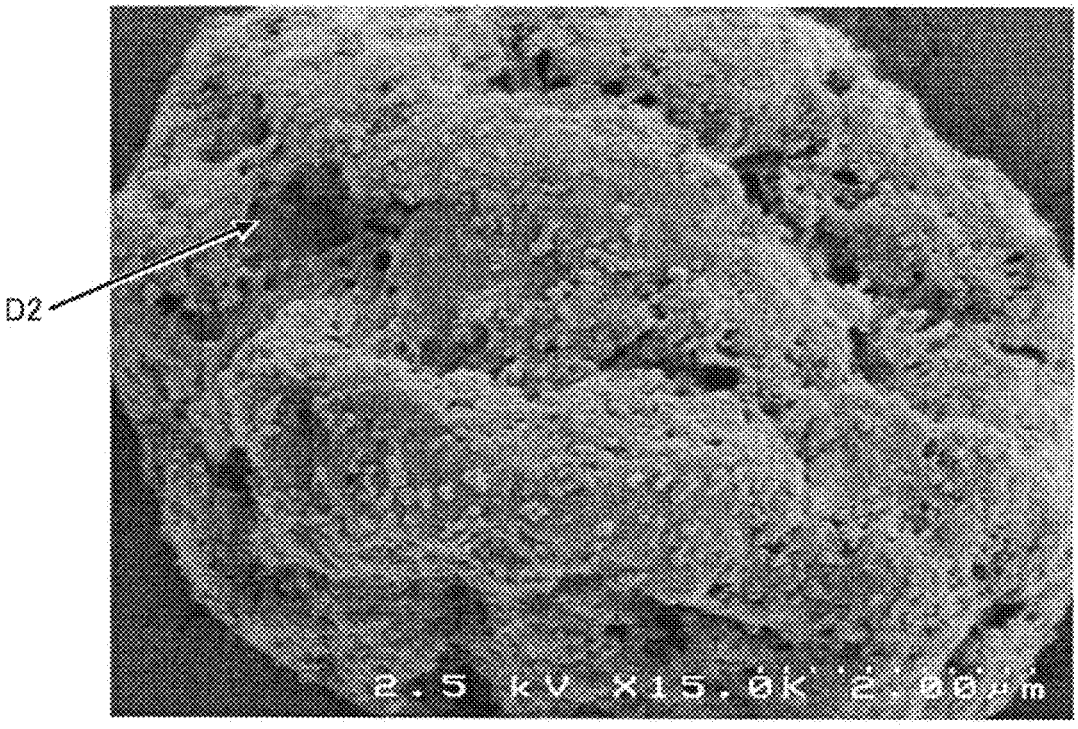
FIG. 3A is a SEM image of a toner particle in accordance with some embodiments of the present invention, having a ratio Sd/St of from 5% to 50%.
Figure 3B:
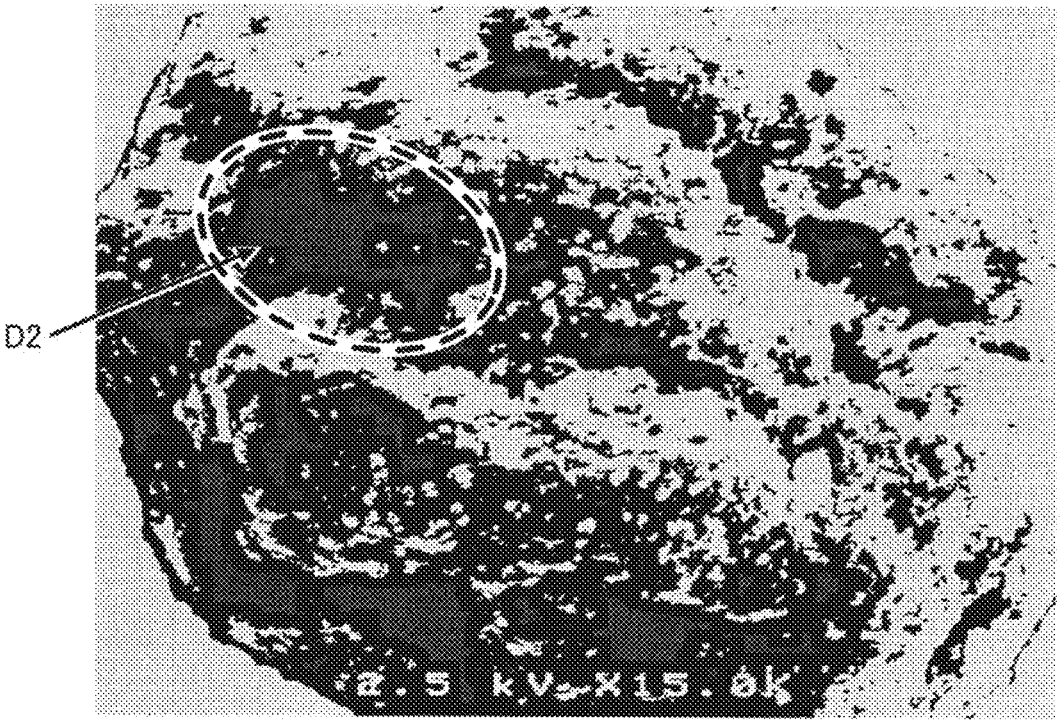
FIG. 3B is a binarized SEM image of FIG. 3A for determining a recessed portion D.

A toner particle shown in FIGS. 3A and 3B has a ratio Sd/St less than 5%. FIG. 3A is an original SEM image before being binarized. FIG. 3B is a binarized SEM image obtained by binarizing the original SEM image (FIG. 3A) by the above-described procedure. In FIG. 3B, the largest recessed portion D is denoted as D2 and roughly enclosed by broken lines. The area Sd of D2 is determined from this image, and then Sd/St is determined to be 2.3%.

In a more magnified SEM image of the toner, toner particles having a ratio Sd/St of from 5% to 50% are present at a frequency of 15% or more, more preferably 30% or more. Although not all the widely and deeply recessed portions are facing the front, it can be assumed that substantially all the toner particles have widely and deeply recessed portions when the frequency is 30% or more. By contrast, when the frequency is less than 15%, it is assumed that the number of toner particles having widely and deeply recessed portions is small, which degrades transfer stability.

Figure 4:
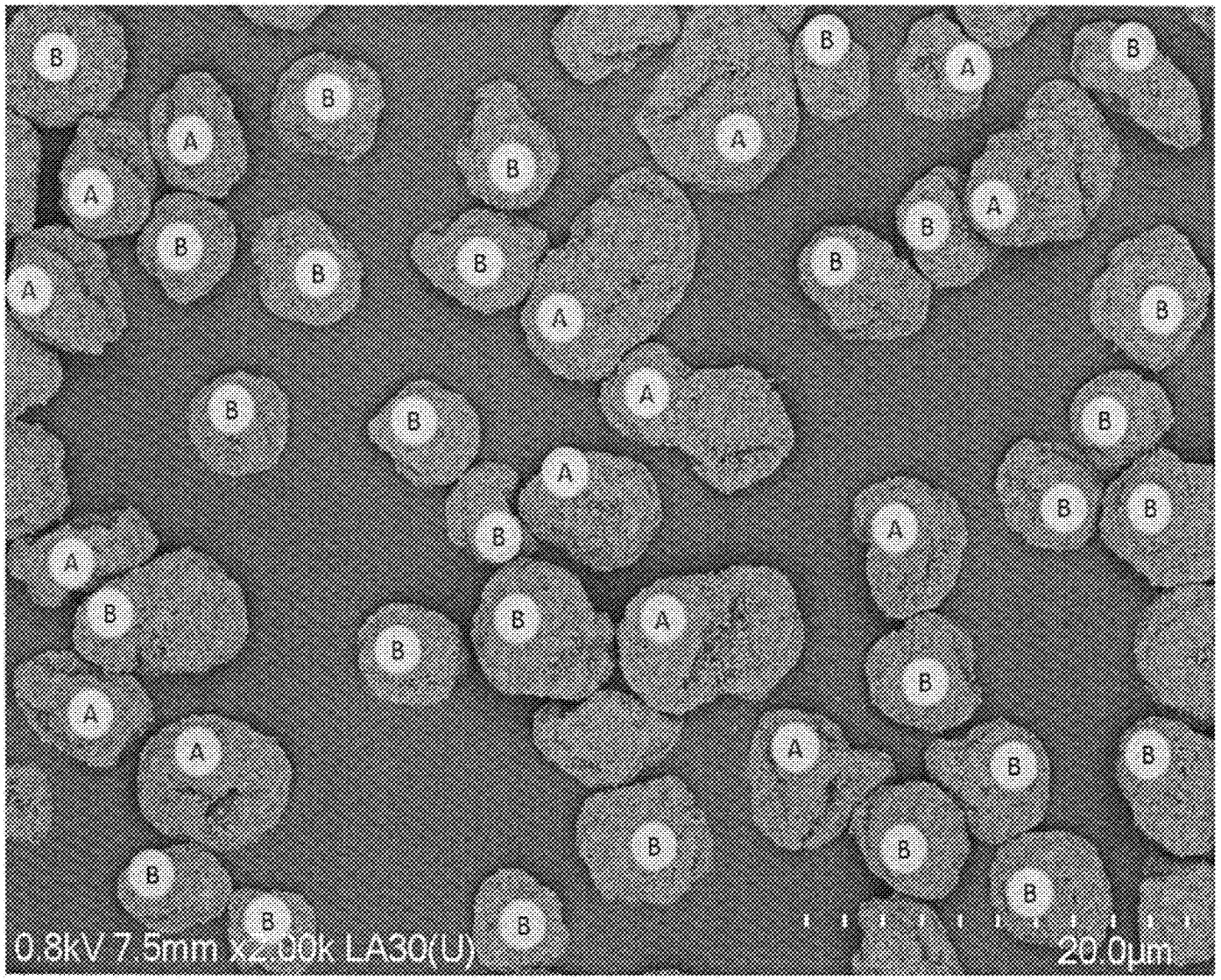
FIG. 4 is a SEM image of a toner in accordance with some embodiments of the present invention, for determining the frequency of toner particles having a ratio Sd/St of from 5% to 50%.

How to determine the frequency is explained below with reference to FIG. 4. FIG. 4 is a SEM image reduced in magnification for displaying multiple toner particles. Sd/St is determined for each of multiple toner particles by the above-described procedure.

Toner particles having a ratio Sd/St of from 5% to 50% are labeled as A, and those having a ratio beyond that range are labeled as B.

In FIG. 4, among 44 toner particles in total, 15 toner particles have a ratio Sd/St of from 5% to 50%. Therefore, the frequency is 34%.

The external additive coverage rate Ca at the largest recessed portion D is from 30% to 100%, preferably 50% or more. When Ca is 50% or more, cohesiveness among toner particles can be greatly reduced. When Ca is less than 30%, cohesiveness among toner particles is increased to degrade transfer stability.

Figure 5:
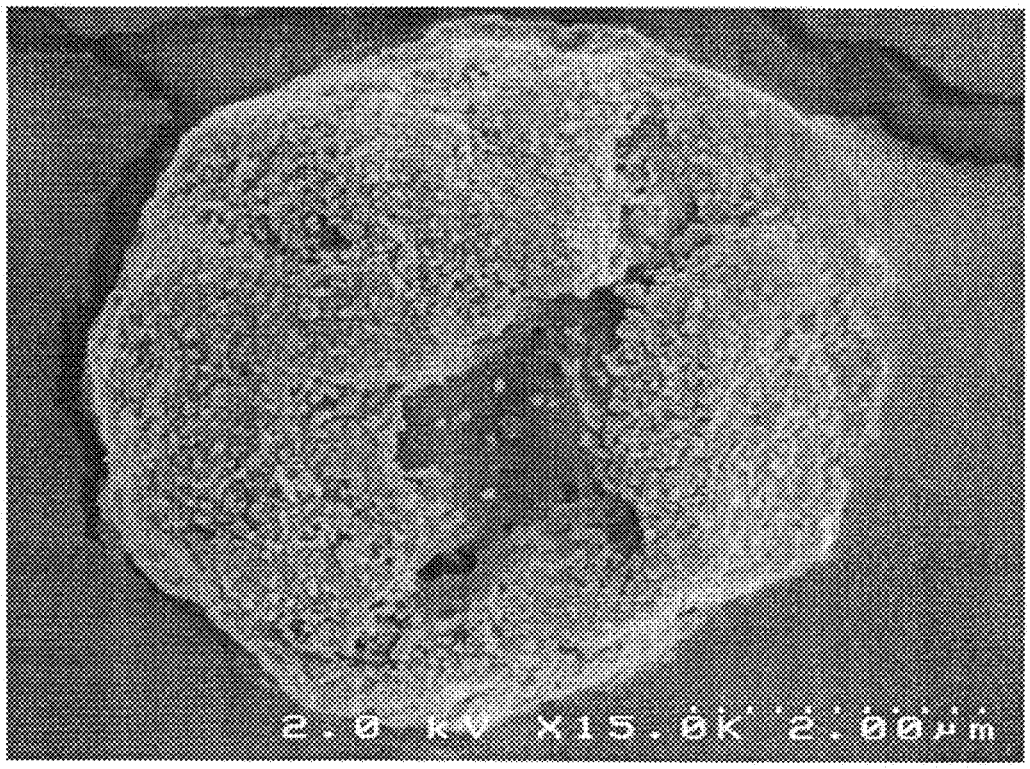
FIG. 5 RELATED ART
FIG. 5 is a SEM image of a related-art toner particle.

The toner particle shown in FIG. 2A has an external additive coverage rate Ca of from 30% to 100%. The surface of the toner particle, even at widely and deeply recessed portions, is sufficiently covered with external additive particles. FIG. 5 is a SEM image of a related-art toner particle having an external additive coverage rate Ca less than 30%. FIG. 5 indicates that widely and deeply recessed portions of the related-art toner particle are covered with a less number of external additive particles.

The external additive coverage rate Ca at the recessed portion D is determined by visually identifying external additive particles at the recessed portion D and counting the number of pixels constituting the external additive particles, and dividing the number of pixels constituting the external additive particles by that constituting the recessed portion D. It is preferable to superimpose the binarized image on the original image so that pixels constituting external additive particles within the recessed portion D are easily identified.

In determining Sd, St, frequency, and Ca described above, preferably, the number of toner particles to be measured is 50 or more, more preferably 100 or more.

Mother Particle

The mother particle has widely and deeply recessed portions. The mother particle comprises a binder resin, and may optionally comprise other components.

Binder Resin

The binder resin comprises an amorphous resin, and may optionally comprise a crystalline resin.

Specific examples of the amorphous resin include, but are not limited to, acrylic resin, styrene-acrylic resin, polyester resin, and epoxy resin. Among these, polyester resin is preferable. Two or more of these resins can be used in combination as necessary.

The amorphous polyester resin may be obtained by a polycondensation between a polyol and a polycarboxylic acid.

Specific preferred examples of the amorphous polyester resin include, but are not limited to, an amorphous polyester resin comprising a divalent aliphatic alcohol component and a polyvalent aromatic carboxylic acid component as constitutional components.

Specific examples of the polyol include, but are not limited to, divalent diols and polyols having 3 to 8 valences or more.

Specific examples of the divalent diols include, but are not limited to, divalent aliphatic alcohols such as straight-chain aliphatic alcohols and branched aliphatic alcohols. Among these, aliphatic alcohols having 2 to 36 carbon atoms in the chain are preferable, and straight-chain aliphatic alcohols having 2 to 36 carbon atoms in the chain are more preferable. Each of these compounds can be used alone or in combination with others.

Specific examples of the straight-chain aliphatic alcohols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among these, ethylene glycol, 1,3-propanediol (propylene glycol), 1,4-butanediol, 1,6-hexanediol, 1,9-nonanediol, and 1,10-decanediol are preferable because they are readily available. Among these, straight-chain aliphatic alcohols having 2 to 36 carbon atoms in the chain are preferable.

Specific examples of the polycarboxylic acid include, but are not limited to, dicarboxylic acids and polycarboxylic acids having 3 to 6 valences or more. Among these, polyvalent aromatic carboxylic acids are preferable.

Specific examples of the dicarboxylic acids include, but are not limited to, aliphatic dicarboxylic acids and aromatic dicarboxylic acids. Specific examples of the aliphatic dicarboxylic acids include, but are not limited to, straight-chain aliphatic dicarboxylic acids and branched aliphatic dicarboxylic acids. Among these, straight-chain aliphatic dicarboxylic acids are preferable.

Specific examples of the aliphatic dicarboxylic acids further include, but are not limited to, alkanedicarboxylic acids, alkenyl succinic acids, alkenedicarboxylic acids, and alicyclic dicarboxylic acids.

Specific examples of the alkanedicarboxylic acids include, but are not limited to, alkanedicarboxylic acids having 4 to 36 carbon atoms. Specific examples of the alkanedicarboxylic acids having 4 to 36 carbon atoms include, but are not limited to, succinic acid, adipic acid, sebacic acid, azelaic acid, dodecanedicarboxylic acid, octadecanedicarboxylic acid, and decyl succinic acid.

Specific examples of the alkenyl succinic acids include, but are not limited to, dodecenyl succinic acid, pentadecenyl succinic acid, and octadecenyl succinic acid.

Specific examples of the alkenedicarboxylic acids include, but are not limited to, alkenedicarboxylic acids having 4 to 36 carbon atoms. Specific examples of the alkenedicarboxylic acids having 4 to 36 carbon atoms include, but are not limited to, maleic acid, fumaric acid, and citraconic acid.

Specific examples of the alicyclic dicarboxylic acids include, but are not limited to, alicyclic dicarboxylic acids having 6 to 40 carbon atoms. Specific examples of the alicyclic dicarboxylic acids having 6 to 40 carbon atoms include, but are not limited to, dimer acid (dimerized linoleic acid).

Specific examples of the aromatic dicarboxylic acids include, but are not limited to, aromatic dicarboxylic acids having 8 to 36 carbon atoms. Specific examples of the aromatic dicarboxylic acids having 8 to 36 carbon atoms include, but are not limited to, phthalic acid, isophthalic acid, terephthalic acid, t-butyl isophthalic acid, 2,6-naphthalenedicarboxylic acid, and 4,4'-biphenyl dicarboxylic acid.

Specific examples of the polycarboxylic acids having 3 to 6 valences or more include, but are not limited to, aromatic polycarboxylic acids having 9 to 20 carbon atoms. Specific examples of the aromatic polycarboxylic acids having 9 to 20 carbon atoms include, but are not limited to, trimellitic acid and pyromellitic acid.

In addition, anhydrides and C1-C4 alkyl esters of the above dicarboxylic acids and polycarboxylic acids having 3 to 6 valences or more are also usable. Specific examples of the C1-C4 alkyl esters include, but are not limited to, methyl ester, ethyl ester, and isopropyl ester.

Specific examples of the crystalline resin include, but are not limited to, acrylic resin, styrene-acrylic resin, polyester resin, and epoxy resin. Among these, polyester resin is preferable.

The crystalline polyester resin has a heat melting property such that the viscosity rapidly decreases at around the fixing start temperature due to its high crystallinity. The crystalline polyester resin never starts melting even when the temperature reaches immediately below the melting start temperature, thereby providing excellent heat-resistant storage stability. At the melting start temperature, the crystalline polyester resin melts and the viscosity of the crystalline polyester resin rapidly decreases. As a result, the crystalline polyester resin gets compatibilized with the amorphous resin and fixed on a recording medium. Thus, the toner exhibits excellent heat-resistant storage stability and low-temperature fixability. In addition, the toner exhibits a wide releasable temperature range, i.e., a large difference between the lowest fixable temperature and the high-temperature offset generating temperature.

The crystalline polyester resin may be obtained by a polycondensation between a polyol and a polycarboxylic acid. The polycarboxylic acid may be replaced with an anhydride, a C1-C3 lower alkyl ester, or a halide thereof.

Specific examples of the polyol include, but are not limited to, diols and alcohols having 3 or more valences. Two or more of these polyols can be used in combination.

Specific examples of the diols include, but are not limited to, saturated aliphatic di of s.

Examples of the saturated aliphatic diols include, but are not limited to, straight-chain saturated aliphatic diols and branched saturated aliphatic diols. Among these, straight-chain saturated aliphatic diols are preferable for obtaining a crystalline polyester having high crystallinity, and straight-chain saturated aliphatic diols having 2 to 12 carbon atoms are more preferable because they are readily available.

Specific examples of the saturated aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among these diols, ethylene glycol, 1,4-butanediol, 1,6-hexanediol, 1,8-octanediol, 1,10-decanediol, and 1,12-dodecanediol are preferable for obtaining a crystalline polyester having high crystallinity and sharply-melting property.

Specific examples of the alcohols having 3 or more valences include, but are not limited to, glycerin, trimethylolethane, trimethylolpropane, and pentaerythritol.

Specific examples of the polycarboxylic acid include, but are not limited to, divalent carboxylic acids and carboxylic acids having 3 or more valences.

Specific examples of the divalent carboxylic acids include, but are not limited to, saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acids such as diprotic acids such as phthalic acid, isophthalic acid, terephthalic acid, naphthalene-2,6-dicarboxylic acid, malonic acid, and mesaconic acid.

Specific examples of the carboxylic acids having 3 or more valences include, but are not limited to, 1,2,4-benzenetricarboxylic acid, 1,2,5-benzenetricarboxylic acid, and 1,2,4-naphthalenetricarboxylic acid.

The polycarboxylic acid may include a dicarboxylic acid having sulfonic acid group.

The polycarboxylic acid may include a dicarboxylic acid having carbon-carbon double bond.

Preferably, the crystalline polyester resin has a structural unit derived from a straight-chain saturated aliphatic dicarboxylic acid having 4 to 12 carbon atoms and another structural unit derived from a straight-chain saturated aliphatic diol having 2 to 12 carbon atoms. Such a crystalline polyester resin has high crystallinity and sharply-melting property. As a result, low-temperature fixability of the toner is improved.

Preferably, the crystalline polyester resin has a melting point of from 60° C. to 90° C., more preferably from 60° C. to 80° C. When the melting point of the crystalline polyester resin is 60° C. or more, heat-resistant storage stability of the toner is improved. When the melting point of the crystalline polyester resin is 90° C. or less, low-temperature fixability of the toner is improved.

Preferably, the crystalline polyester resin has a weight average molecular weight of from 3,000 to 30,000, more preferably from 5,000 to 15,000. When the weight average molecular weight of the crystalline polyester resin is 3,000 or more, heat-resistant storage stability of the toner is improved. When the weight average molecular weight of the crystalline polyester resin is 30,000 or less, low-temperature fixability of the toner is improved.

Preferably, the crystalline polyester resin has an acid value of 5 mgKOH/g or more, more preferably 10 mgKOH/g or more. In this case, low-temperature fixability of the toner is improved. In addition, the crystalline polyester resin has an acid value of 45 mgKOH/g or less. In this case, high-temperature offset resistance of the toner is improved.

Preferably, the crystalline polyester resin has a hydroxyl value of 50 mgKOH/g or less, more preferably from 5 to 50 mgKOH/g. When the hydroxyl value of the crystalline polyester resin is 50 mgKOH/g or less, low-temperature fixability and chargeability of the toner are improved.

The molecular structure of the crystalline polyester resin can be determined by, for example, solution or solid NMR (nuclear magnetic resonance), X-ray diffractometry, GC/MS (gas chromatography—mass spectroscopy), LC/MS (liquid chromatography—mass spectroscopy), or IR (infrared spectroscopy). For example, IR can simply detect a crystalline polyester resin as a substance showing an absorption peak based on δCH (out-of-plane bending vibration) of olefin at 965±10 $cm^{-1}$ or 990±10 $cm^{-1}$ in an infrared absorption spectrum.

Preferably, a content rate of the crystalline polyester resin in the toner is from 3% to 20% by mass, more preferably from 5% to 15% by mass. When the content rate of the crystalline polyester resin in the toner is 3% by mass or more, low-temperature fixability of the toner is improved. When the content rate is 20% by mass of less, heat-resistant storage stability of the toner is improved and the occurrence of image fogging is suppressed.

Other Components

Examples of the other components include, but are not limited to, a release agent, a colorant, a charge controlling agent, a cleanability improving agent, and a magnetic material.

Specific examples of the release agent include, but are not limited to, plant waxes (e.g., carnauba wax, cotton wax, sumac wax, and rice wax), animal waxes (e.g., bees wax and lanolin), mineral waxes (e.g., ozokerite and ceresin), petroleum waxes (e.g., paraffin wax, micro-crystalline wax, and petrolatum wax), hydrocarbon waxes (e.g., Fischer-Tropsch wax, polyethylene wax, and polypropylene wax), synthetic waxes (e.g., ester, ketone, and ether), and fatty acid amide compounds (e.g., 12-hydroxystearic acid amide, stearic acid amide, and phthalic anhydride imide). Among these materials, hydrocarbon waxes such as paraffin wax, micro-crystalline wax, Fischer-Tropsch wax, polyethylene wax, and polypropylene wax are preferable.

Preferably, the release agent has a melting point of from 60° C. to 80° C. When the melting point of the release agent is 60° C. or more, heat-resistant storage stability of the toner is improved. When the melting point of the release agent is 80° C. or less, high-temperature offset resistance of the toner is improved.

Preferably, a content rate of the release agent in the toner is from 2% to 10% by mass, more preferably from 3% to 8% by mass. When the content rate of the release agent in the toner is 2% by mass or more, high-temperature offset resistance and low-temperature fixability of the toner are improved. When the content rate is 10% by mass of less, heat-resistant storage stability of the toner is improved and the occurrence of image fogging is suppressed.

Specific examples of the colorant include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

Preferably, a content rate of the colorant in the toner is from 1% to 15% by mass, more preferably from 3% to 10% by mass.

The colorant can be combined with a resin to be used as a master batch.

Specific examples of the resin to be used for the master batch include, but are not limited to, amorphous polyester resins, polymers of styrene or a derivative thereof (e.g., polystyrene, poly-p-chlorostyrene, polyvinyl toluene), styrene-based copolymers (e.g., styrene -p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, and aliphatic or alicyclic hydrocarbon resin. Two or more of these resins can be used in combination.

The master batch can be obtained by mixing and kneading the resin and the colorant. To increase the interaction between the colorant and the resin, an organic solvent may be used.

More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried.

The mixing and kneading may be performed by a high shearing dispersing device such as a three roll mill.

Specific examples of the cleanability improving agent include, but are not limited to, metal salts of fatty acids (e.g., zinc stearate and calcium stearate) and polymer particles prepared by soap-free emulsion polymerization (e.g., polymethyl methacrylate particles and polystyrene particles).

Preferably, the polymer particles have a volume average particle diameter of from 0.01 to 1 μm.

Specific examples of the magnetic material include, but are not limited to, iron, magnetite, and ferrite. Among these materials, those having a white color are preferred in terms of color tone.

External Additive Particles

The external additive particles are not limited to any particular material so long as the specified external additive coverage rate can be achieved. Specific examples of the external additive particles include, but are not limited to, oxide particles (e.g., silica particles, titania particles, alumina particles, tin oxide particles, titanium oxide particles, and antimony oxide particles), fatty acid metal salts (e.g., zinc stearate and aluminum stearate), and fluoropolymer particles. In particular, hydrophobized silica, titania, titanium oxide, and alumina particles are preferable. Two or more of these materials can be used in combination as necessary.

Preferably, the external additive particles have a number average particle diameter of from 0.03 to 0.10 μm, and a particle diameter distribution of the external additive particles indicated in a Rosin-Rammler diagram has a gradient n of from 0.8 to 1.6. The greater the gradient n in the Rosin-Rammler diagram becomes, the sharper the particle diameter distribution becomes. The smaller the gradient n in the Rosin-Rammler diagram becomes, the broader the particle diameter distribution becomes. When the gradient n is from 0.8 to 1.6, the external additive particles are in an appropriate aggregation state and easily roll on the surface of the mother particle. Thus, the external additive particles easily move from projected portions to recessed portions of the mother particle, thereby effectively cover the recessed portions of the mother particle.

For most effectively covering the recessed portions of the mother particle, the number average particle diameter of the external additive particles is in the range of from 0.03 to 0.10 μm. When the number average particle diameter is less than 0.03 μm, the external additive particles have poor durability, so that they are easily embedded in the mother particle, possibly casing quality deterioration with time. When the number average particle diameter is in excess of 0.10 μm, the external additive particles easily release from the mother particle. In particular, this phenomenon notably occurs when the external additive particles have an aggregation structure, resulting in insufficient covering of the recessed portions.

Figure 6:
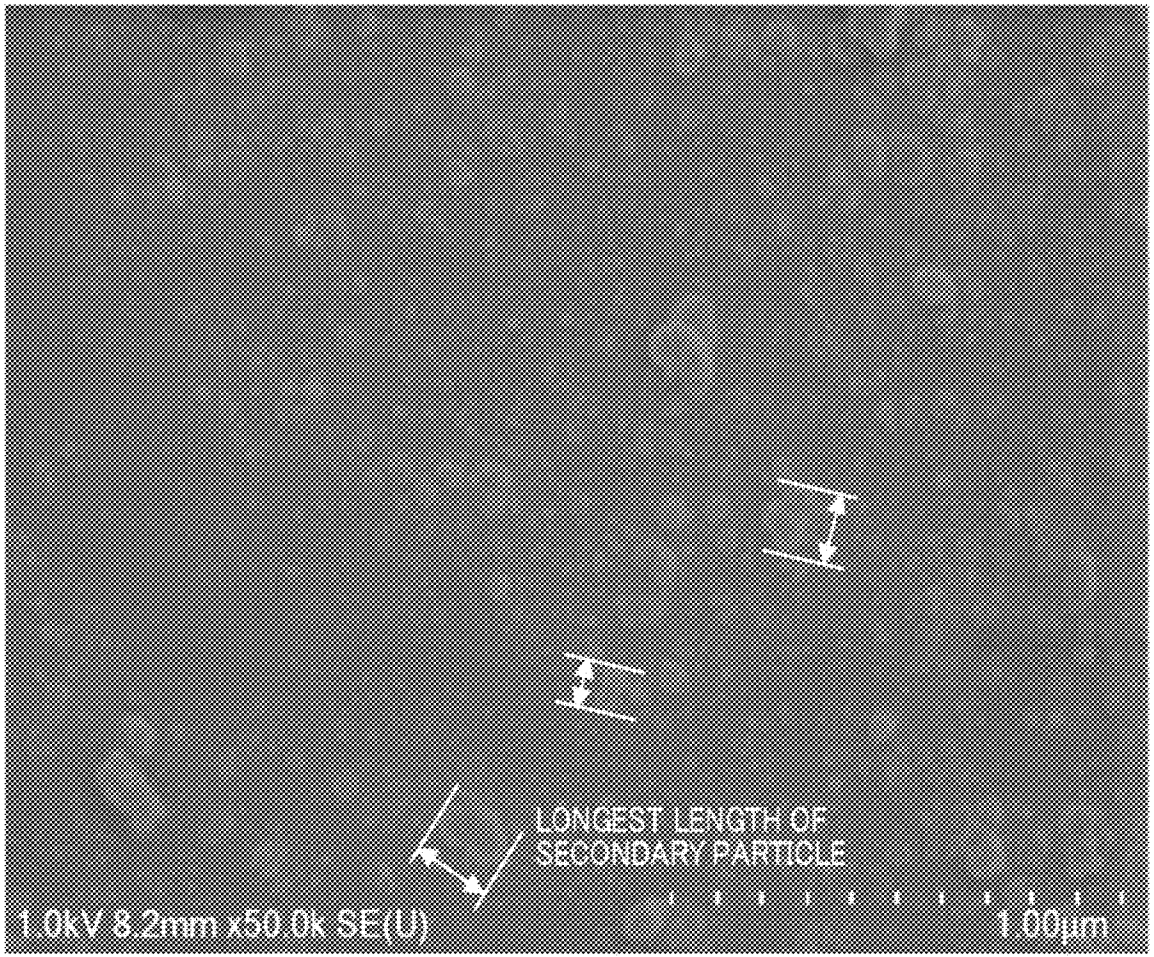
FIG. 6 is a SEM image of external additive particles in accordance with some embodiments of the present invention.

The number average particle diameter of the external additive particles can be measured by obtaining a SEM image of the external additive particles and analyzing the image. Specifically, first, the external additive particles are dispersed in an appropriate solvent (e.g., tetrahydrofuran) and thereafter fixedly dried on a substrate by removing the solvent. The dried external additive particles are observed with SEM to obtain an image as illustrated in FIG. 6. In the image, the longest length of each secondary particle or primary particle is measured and the measured values are averaged. Thus, the number average particle diameter is determined. Preferably, the number of particles to be measured is at least 200.

Figure 7:
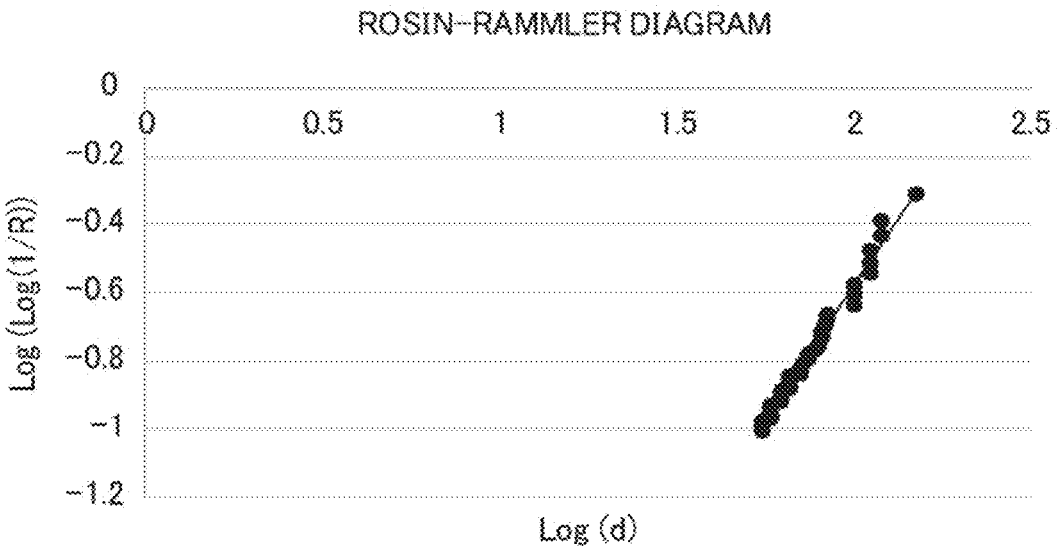
FIG. 7 is a Rosin-Rammler diagram of external additive particles in accordance with some embodiments of the present invention.

The gradient n indicated in a Rosin-Rammler diagram can be determined by calculating an oversized particle distribution of the external additive particles, based on Rosin-Rammler distribution, from the particle diameter distribution obtained when measuring the number average particle diameter by measuring the longest length of each particle, and creating a Rosin-Rammler diagram. The gradient n can be determined by obtaining a straight line by a least-square method within a cumulative volume fraction range of from 30% to 70% as illustrated in FIG. 7, and measuring the gradient of the straight line. In the embodiment illustrated in FIG. 7, the gradient n is 1.58.

In the present disclosure, the Rosin-Rammler diagram refers to a particle size diagram indicating a particle diameter distribution satisfying the following Rosin-Rammler equation (1) as described in JP-2006-206414-A.

$$R(Dp)=100\exp(-b\cdot Dp^{n}) \quad (1)$$

where Dp represents a particle diameter, R(Dp) represents a cumulative volume fraction (%) within a range of from the maximum particle diameter to the particle diameter Dp, and b and n are constants.

The particle diameter and shape of the external additive particles can be controlled by varying the type of material and conditions of manufacturing method, hydrophobizing treatment, and pulverization and classification treatments.

In particular, silica particles as the external additive particles may be manufactured by dry methods such as flame hydrolysis method and flame combustion method, or wet methods such as sol-gel method, but the manufacturing method is not limited thereto so long as the specified external additive coverage rate can be achieved. For obtaining adequate particle diameter and particle diameter distribution, flame combustion method is preferable.

In the flame combustion method, a burner having a multiplex pipe structure is preferably used. For example, the burner may have a central pipe and an annular pipe formed on the outer periphery of the central pipe. In the central pipe, a vaporized raw-material silicon compound and oxygen, optionally along with an inert gas such as nitrogen gas, may be introduced. In the annular pipe, fuels for forming auxiliary flame, such as hydrogen and hydrocarbon, optionally along with an inert gas such as nitrogen gas, may be introduced. By combusting these materials, the silicon compound can be converted into silica particles and the silica particles can be appropriately fused with each other in the flame. The burner may further include a second annular pipe and a third annular pipe on the outer periphery thereof, as necessary. The fused silica particles are collected by being cooled in a dispersed state.

The average particle diameter can be controlled by, for example, increasing the concentration of the raw-material silicon compound, elongating the length of the outer-periphery flame, or increasing the temperature of the outer-periphery flame. The particle diameter distribution can be controlled by, for example, adjusting the concentration of silica in the flame.

The oxide particles, as the external additive particles, can be hydrophobized with a hydrophobizing agent such as a silane coupling agent and a silicone oil.

Specific examples of the silane coupling agent include, but are not limited to, hexamethyldisilazane, methyl trimethoxysilane, methyl triethoxysilane, and octyl trimethoxysilane.

Specific examples of the silicone oil include, but are not limited to, dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methylstyrene-modified silicone oil.

The hydrophobizing treatment may include, for example, spraying the hydrophobizing agent to the oxide particles, or mixing the vaporized hydrophobizing agent and the oxide particles with heat. In the treatment, water, an amine, and/or other catalysts may be used. Such dry surface treatments are preferably performed under an inert gas (e.g., nitrogen gas) atmosphere. Alternatively, the hydrophobizing treatment may include dissolving the hydrophobizing agent in a solvent and further mixing and dispersing the oxide particles therein, optionally with heat, followed by drying. In this case, the hydrophobizing agent may be added to the solvent either after or at the time when the oxide particles are mixed and dispersed in the solvent.

Preferably, a content rate of the external additive particles in the toner is from 0.1% to 5% by mass, more preferably from 0.3% to 3% by mass.

Preferably, the oxide particles have an average primary particle diameter of from 1 to 100 nm, more preferably from 3 to 70 nm. When the average primary particle diameter of the oxide particles is 1 nm or more, the oxide particles are suppressed from being embedded in the mother particle. When the average primary particle diameter is 100 nm or less, the occurrence of uneven flaws on a photoconductor is suppressed.

Method for Manufacturing Toner

A method for manufacturing the mother particle is not particularly limited so long as the resulting mother particle has a desired shape. For example, the mother particle may be manufactured by a dissolution suspension method.

Preferably, the mother particle is manufactured by emulsifying or dispersing an oil phase containing an amorphous polyester prepolymer A having an isocyanate group, an amorphous polyester B, optionally a crystalline polyester C, a release agent, and a colorant, in an aqueous medium.

Preferably, resin particles are dispersed in the aqueous medium.

The resin particles comprise a resin capable of being dispersed in the aqueous medium. Specific examples of such a resin include, but are not limited to, vinyl resin, polyurethane resin, epoxy resin, polyester resin, polyamide resin, polyimide resin, silicone resin, phenol resin, melamine resin, urea resin, aniline resin, ionomer resin, and polycarbonate resin. Two or more of these resins can be used in combination. Among these resins, vinyl resin, polyurethane resin, epoxy resin, and polyester resin are preferable because fine spherical particles thereof are easily obtainable.

Preferably, the mass ratio of the resin particles in the aqueous medium is from 0.005 to 0.1.

Specific examples of the aqueous medium include, but are not limited to, water and water-miscible solvents. Two or more of them may be used in combination. Among these, water is preferable.

Specific examples of the water-miscible solvents include, but are not limited to, alcohols, dimethylformamide, tetrahydrofuran, cellosolves, and lower ketones.

Specific examples of the alcohols include, but are not limited to, methanol, isopropanol, and ethylene glycol.

Specific examples of the lower ketones include, but are not limited to, acetone and methyl ethyl ketone.

The oil phase may be prepared by dissolving or dispersing toner materials including the amorphous polyester prepolymer A having an isocyanate group, the amorphous polyester B, optionally the crystalline polyester C, the release agent, and the colorant, in an organic solvent.

Preferably, the organic solvent has a boiling point less than 150° C. In this case, the organic solvent can be easily removed.

Specific examples of the organic solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. Among these solvents, ethyl acetate, toluene, xylene, benzene, methylene chloride, 1,2-dichloroethane, chloroform, and carbon tetrachloride are preferable, and ethyl acetate is most preferable.

When the oil phase is emulsified or dispersed in the aqueous medium, the amorphous polyester prepolymer A having an isocyanate group reacts with a compound having an active hydrogen group to produce an amorphous polyester A.

The amorphous polyester A may be produced by one of the following procedures (1) to (3).

(1) Emulsify or disperse an oil phase containing the amorphous polyester prepolymer A having an isocyanate group and the compound having an active hydrogen group in an aqueous medium, to cause an elongation reaction and/or a cross-linking reaction between the compound having an active hydrogen group and the amorphous polyester prepolymer A having an isocyanate group in the aqueous medium, thereby forming the amorphous polyester resin A.

(2) Emulsify or disperse an oil phase containing the amorphous polyester prepolymer A having an isocyanate group in an aqueous medium to which the compound having an active hydrogen group has been previously added, to cause an elongation reaction and/or a cross-linking reaction between the compound having an active hydrogen group and the amorphous polyester prepolymer A having an isocyanate group in the aqueous medium, thereby forming the amorphous polyester resin A.

(3) Emulsify or disperse an oil phase containing the amorphous polyester prepolymer A having an isocyanate group in an aqueous medium and thereafter add the compound having an active hydrogen group to the aqueous medium, to cause an elongation reaction and/or a cross-linking reaction between the compound having an active hydrogen group and the amorphous polyester prepolymer A having an isocyanate group in the aqueous medium from the interfaces of dispersed particles, thereby forming the amorphous polyester resin A.

In a case in which an elongation reaction and/or a cross-linking reaction between the compound having an active hydrogen group and the amorphous polyester prepolymer A having an isocyanate group is caused from the interfaces of dispersed particles, the amorphous polyester A is preferentially formed at the surface of the resulting toner while forming a concentration gradient of the amorphous polyester A within the toner.

Preferably, the reaction time between the compound having an active hydrogen group and the amorphous polyester prepolymer A having an isocyanate group is from 10 minutes to 40 hours, more preferably from 2 to 24 hours.

Preferably, the reaction temperature between the compound having an active hydrogen group and the amorphous polyester prepolymer A having an isocyanate group is from 0° C. to 150° C., more preferably from 40° C. to 98° C.

When reacting the compound having an active hydrogen group with the amorphous polyester prepolymer A having an isocyanate group, a catalyst may be used.

Specific examples of the catalyst include, but are not limited to, dibutyltin laurate and dioctyltin laurate.

The oil phase may be emulsified or dispersed in the aqueous medium with a shearing force.

The oil phase may be emulsified or dispersed in the aqueous medium by a disperser such as low-speed shearing type dispersers, high-speed shearing type dispersers, friction type dispersers, high-pressure jet type dispersers, and ultrasonic dispersers. Among these dispersers, high-speed shearing type dispersers are preferable because they can adjust the particle diameter of the dispersoids (oil droplets) to 2 to 20 μm.

When a high-speed shearing type disperser is used, the revolution is typically from 1,000 to 30,000 rpm, preferably from 5,000 to 20,000 rpm. The dispersing time for a batch type disperser is preferably from 0.1 to 5 minutes. The dispersing temperature is preferably from 0° C. to 150° C., more preferably from 40° C. to 98° C., under pressure.

Preferably, the mass ratio of the aqueous medium to the toner materials is from 0.5 to 20, more preferably from 1 to 10. When the mass ratio is 0.5 or more, the oil phase can be well dispersed. When the mass ratio is 20 or less, it is advantageous in terms of cost.

Preferably, the aqueous medium contains a dispersant for improving dispersion stability of oil droplets, forming mother particles into a desired shape, and narrowing the particle size distribution of the mother particles, as the oil phase is emulsified or dispersed in the aqueous medium.

Examples of the dispersant include, but are not limited to, surfactants, poorly-water-soluble inorganic compound dispersants, and polymeric protection colloids. Two or more of these dispersants can be used in combination. Among these, surfactants are preferable.

Examples of the surfactants include anionic surfactants, cationic surfactants, nonionic surfactants, and ampholytic surfactants. Among these, surfactants having a fluoroalkyl group are preferable.

Specific examples of the anionic surfactants include, but are not limited to, alkylbenzene sulfonate, α-olefin sulfonate, and phosphate.

Preferably, the aqueous medium further contains an aggregating agent for forming mother particles having large and wide recessed portions, which satisfy the shape requirement in accordance with some embodiments of the present invention.

Specific examples of the aggregating agent include, but are not limited to, inorganic metal salts and metal complexes having 2 or more valences. Two or more of these compounds can be used in combination. Among these, inorganic metal salts are preferable.

Specific examples of the inorganic metal salts include, but are not limited to, sodium salts, magnesium salts, aluminum salts, and polymers thereof. For easily controlling particle diameter and shape of the toner, sodium salts are preferable, such as sodium chloride and sodium sulfate.

Preferably, a content rate of the aggregating agent in the aqueous medium is from 1.2% to 5.0% by mass, more preferably from 1.2% to 3.0% by mass, based on solid contents.

Preferably, mother particles are formed by removing the organic solvent after the oil phase is dispersed in the aqueous medium.

The organic solvent may be removed by, for example, gradually raising the temperature of the aqueous medium in which the oil phase is dispersed to completely evaporate the organic solvent from oil droplets, or spraying the aqueous medium in which the oil phase is dispersed into dry atmosphere to completely evaporate the organic solvent from oil droplets.

Preferably, the mother particles are dried after being washed. At this time, the mother particles may also be classified. Specifically, the classification may be performed by removing ultrafine particles from the mother particles contained in the aqueous medium by cyclone separation, decantation, or centrifugal separation. Alternatively, the classification may be performed after the mother toner particles have been dried.

The toner can be obtained by mixing the mother particles with the external additive particles, optionally with a charge controlling agent. By applying a mechanical impact force to the mixture, the external additive particles can be suppressed from releasing from the surface of the mother particles.

The mechanical impact force may be applied to the mixture by rotating blades at a high speed, or putting the mixture in a high-speed airflow to allow the mother particles collide with each other or a collision plate.

The mechanical impact force may be applied to the mixture by using commercially-available products such as ONG MILL (from Hosokawa Micron Co., Ltd.), I-TYPE MILL (from Nippon Pneumatic Mfg. Co., Ltd.) by modifying such that the pulverizing air pressure is reduced, HYBRIDIZATION SYSTEM (from Nara Machine Co., Ltd.), and KRYPTON SYSTEM (from Kawasaki Heavy Industries, Ltd.).

Developer

The developer in accordance with some embodiments of the present invention comprises the above-described toner and optionally other components such as a carrier. The developer may be either a one-component developer or a two-component developer.

Preferably, the carrier comprises a core material and a protective layer formed on the core material.

The core material may be made of high-magnetization materials such as manganese-strontium materials having a mass susceptibility of from 50 to 90 emu/g, manganese-magnesium materials having a mass susceptibility of from 50 to 90 emu/g, iron having a mass susceptibility of 100 emu/g or more, and magnetite having a mass susceptibility of from 75 to 120 emu/g; or low-magnetization materials such as copper-zinc materials having a mass susceptibility of from 30 to 80 emu/g. Two or more of these materials can be used in combination.

Preferably, the core material has a volume average particle diameter of from 10 to 150 μm, more preferably from 40 to 100 μm.

Preferably, a content rate of the carrier in the two-component developer is from 90% to 98% by mass, more preferably from 93% to 97% by mass.

Preferably, the developer is stored in a container. The container may include a container body and a cap. The container body may have a cylindrical shape.

Preferably, on the inner circumferential surface of the container body, projections and recesses are formed in a spiral manner, so that the developer can move to the discharge port side as the container body rotates. More preferably, part or all of the projections and recesses formed in a spiral manner have an accordion function.

The container body may be made of a resin such as polyester, polyethylene, polypropylene, polystyrene, polyvinyl chloride, polyacrylic acid, polycarbonate, ABS resin, and polyacetal.

The container storing the developer is easy to preserve, transport, and handle. Therefore, the container is detachably mountable on a process cartridge or an image forming apparatus (to be described later) to supply the developer thereto.

The developer can be used for any image forming apparatus or process cartridge that forms image by electrophotographic method such as magnetic one-component developing method, non-magnetic one-component developing method, and two-component developing method.

Image Forming Apparatus The image forming apparatus in accordance with some embodiments of the present invention includes a photoconductor, a charger to charge the photoconductor, an irradiator to irradiate the charged photoconductor with light to form an electrostatic latent image thereon, and a developing device including the above toner, configured to develop the electrostatic latent image into a toner image with the toner.

Figure 8:
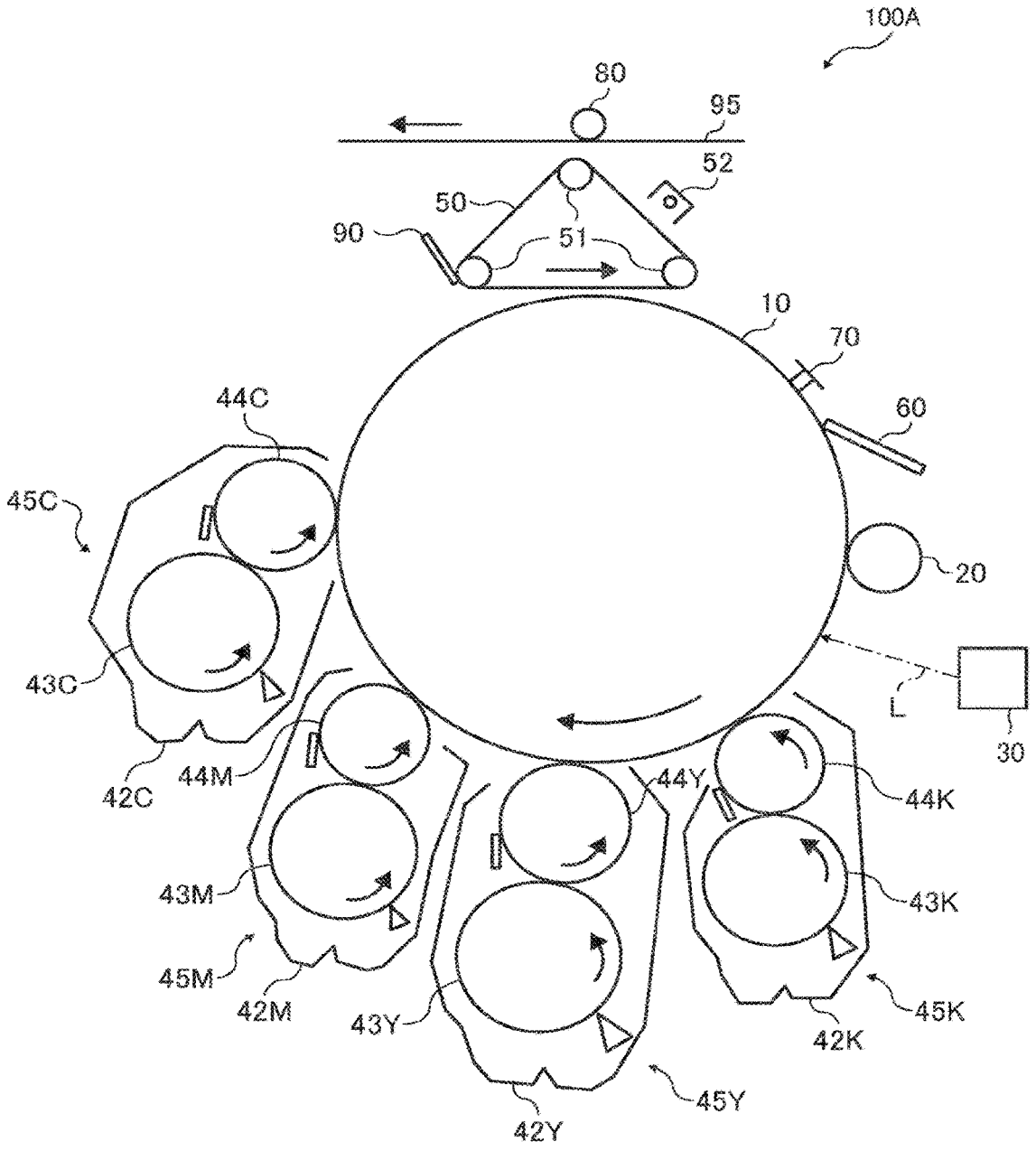
FIG. 8 is a schematic view of an image forming apparatus in accordance with some embodiments of the present invention.

FIG. 8 is a schematic view of an image forming apparatus in accordance with some embodiments of the present invention. An image forming apparatus 100A includes a photoconductor drum 10, a charging roller 20, an irradiator 30, developing devices 45K, 45Y, 45M and 45C (hereinafter collectively "developing devices 45"), an intermediate transfer belt 50, a cleaner 60 having a cleaning blade, and a neutralization lamp 70.

The intermediate transfer belt 50 is supported by three rollers 51 disposed inside the loop thereof and movable in the direction indicated by arrow in FIG. 8. A part of the three rollers 51 also function(s) as transfer bias roller(s) capable of applying a transfer bias to the intermediate transfer belt 50.

A cleaner 90 having a cleaning blade is disposed in the vicinity of the intermediate transfer belt 50. A transfer roller 80 capable of applying a transfer bias to a recoding sheet 95, for transferring the toner image thereon, is disposed facing the intermediate transfer belt 50.

Around the intermediate transfer belt 50, a corona charger 52 to give charge to a toner image on the intermediate transfer belt 50 is disposed between a contact portion of the intermediate transfer belt 50 with the photoconductor drum 10 and another contact portion of the intermediate transfer belt 50 with the recoding sheet 95.

The developing devices 45K, 45Y, 45M, and 45C, for respectively developing black, yellow, magenta, and cyan images, include respective developer containers 42K, 42Y, 42M, and 42C, respective developer supply rollers 43K, 43Y, 43M, and 43C, and respective developing rollers 44K, 44Y, 44M, and 44C.

In the image forming apparatus 100A, first, the charging roller 20 uniformly charges the photoconductor drum 10, and the irradiator 30 emits light L to the photoconductor drum 10, so that an electrostatic latent image is formed. Next, the developing devices 45 supply the developers to the electrostatic latent image formed on the photoconductor drum 10 to form a toner image. The toner image is transferred onto the intermediate transfer belt 50 by a transfer bias applied from the rollers 51. After the corona charger 52 has given charge to the toner image on the intermediate transfer belt 50, the toner image is transferred onto the recoding sheet 95. Residual toner particles remaining on the photoconductor drum 10 are removed by the cleaner 60. The photoconductor drum 10 is neutralized by the neutralization lamp 70.

Figure 9:
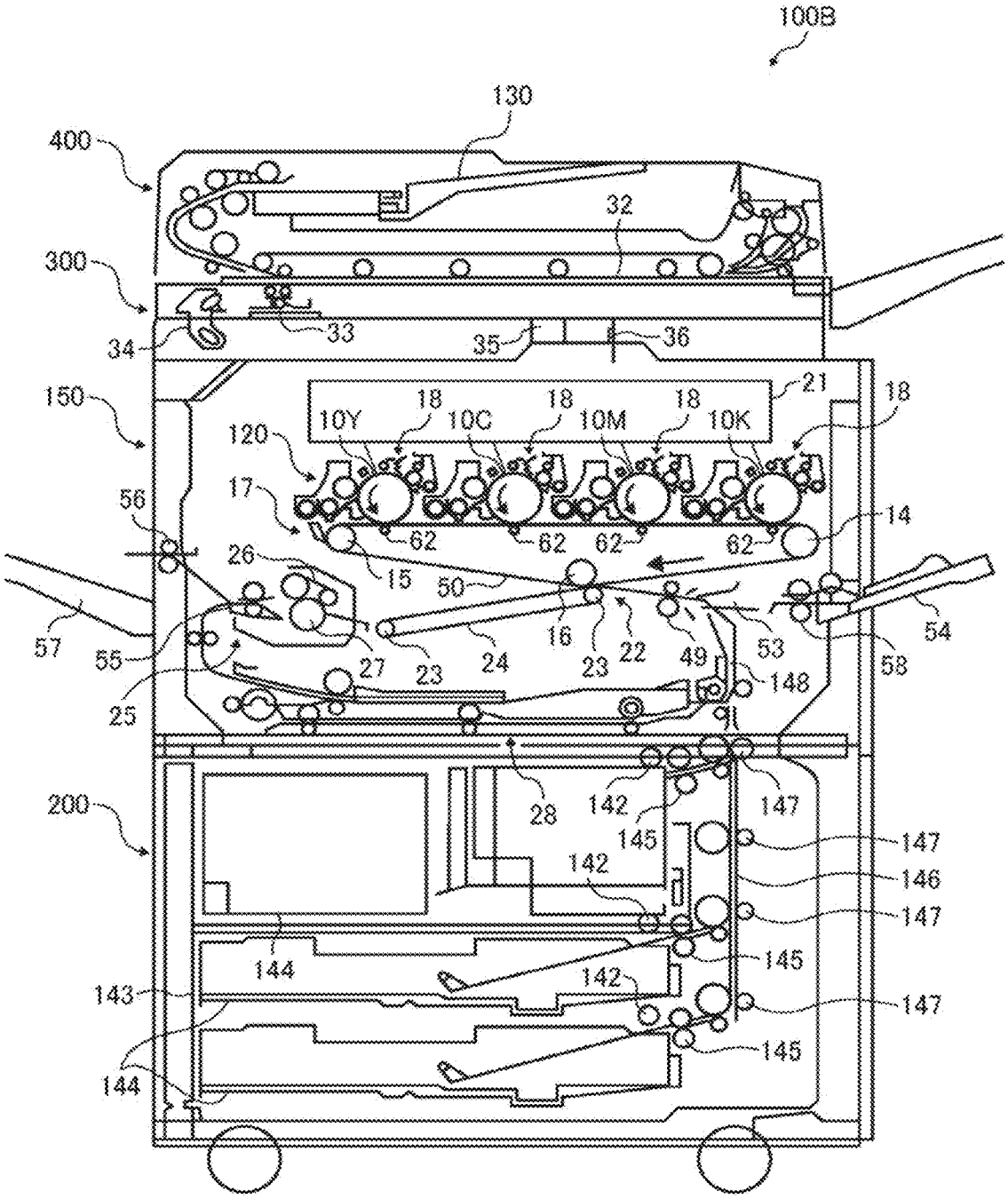
FIG. 9 is a schematic view of an image forming apparatus in accordance with some embodiments of the present invention.

FIG. 9 is a schematic view of an image forming apparatus in accordance with some embodiments of the present invention. An image forming apparatus 100B, which is a tandem-type full-color image forming apparatus, includes a copier main body 150, a sheet feed table 200, a scanner 300, and an automatic document feeder (ADF) 400.

In the central part of the copier main body 150, an intermediate transfer belt 50 is disposed. The intermediate transfer belt 50 is supported by rollers 14, 15, and 16 and rotatable in the direction indicated by arrow in FIG. 9.

In the vicinity of the roller 15, a cleaner 17 for removing residual toner particles remaining on the intermediate transfer belt 50 is disposed. Four image forming units 18 for respectively forming yellow, cyan, magenta, and black images are arranged in tandem facing a part of the intermediate transfer belt 50 stretched between the support rollers 14 and 15, thus forming a tandem unit 120.

Figure 10:
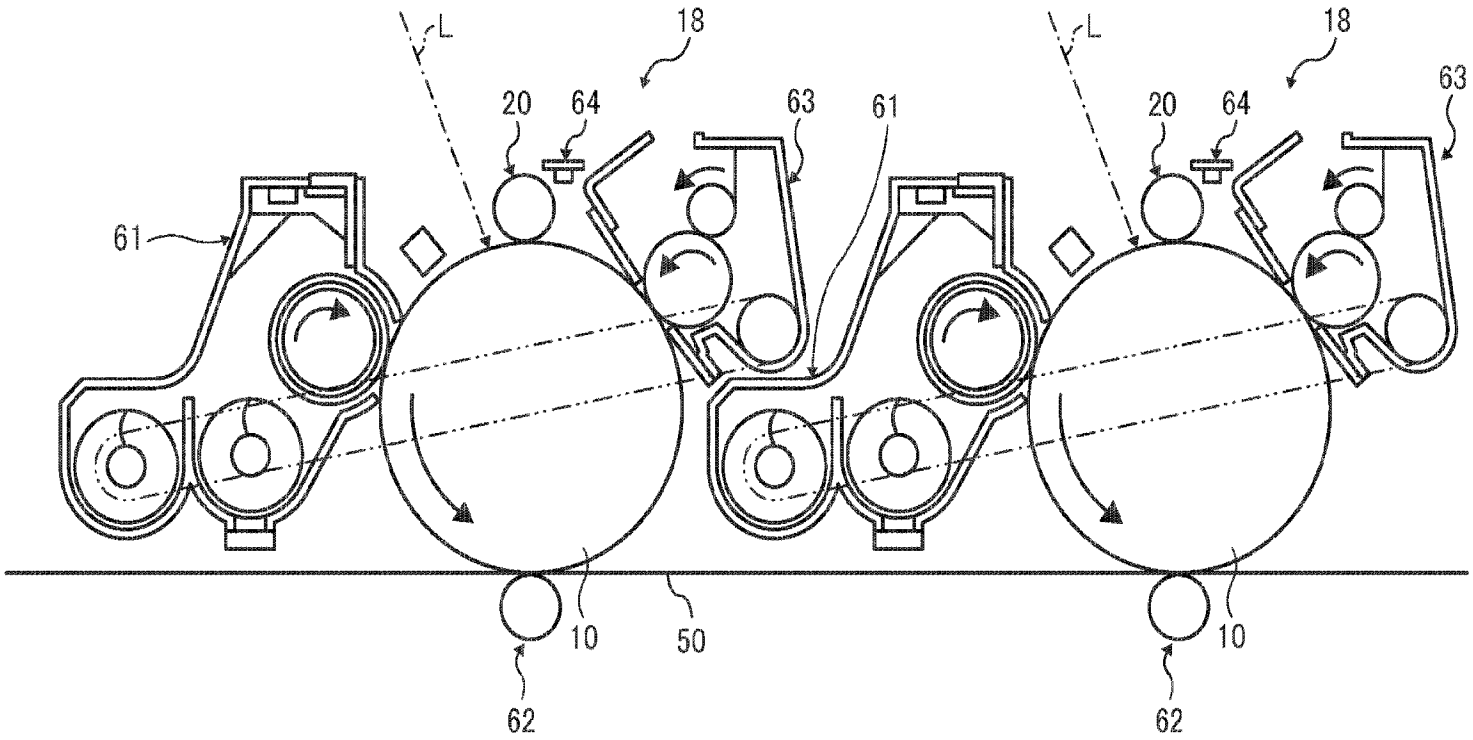
FIG. 10 is a magnified view of an image forming unit included in the image forming apparatus illustrated in FIG. 9.

Referring to FIG. 10, each image forming unit 18 includes a photoconductor drum 10, a charging roller 20 to uniformly charge the photoconductor drum 10, a developing device 61 to develop an electrostatic latent image formed on the photoconductor drum 10 into a toner image with a developer of black, yellow, magenta, or cyan color, a transfer roller 62 to transfer the toner image onto the intermediate transfer belt 50, a cleaner 63, and a neutralization lamp 64.

An irradiator 21 is disposed in the vicinity of the tandem unit 120. The irradiator 21 emits light L to the photoconductor drum 10 to form an electrostatic latent image thereon.

Referring to FIG. 9, a transfer device 22 is disposed on the opposite side of the tandem unit 120 relative to the intermediate transfer belt 50. The transfer device 22 includes a transfer belt 24 supported by a pair of rollers 23. A recording sheet conveyed on the transfer belt 24 and the intermediate transfer belt 50 can contact with each other.

A fixing device 25 is disposed in the vicinity of the transfer device 22. The fixing device 25 includes a fixing belt 26 and a pressing roller 27 pressed against the fixing belt 26.

In the vicinity of the transfer device 22 and the fixing device 25, a sheet reversing device 28 is disposed for reversing the recording sheet so that images can be formed on both surfaces of the recording sheet.

A full-color image forming operation performed in the image forming apparatus 100B is described below. First, a document is set on a document table 130 of the automatic document feeder 400. Alternatively, a document is set on a contact glass 32 of the scanner 300 while the automatic document feeder 400 is lifted up, followed by holding down of the automatic document feeder 400.

As a start switch is pressed, the scanner 300 starts driving after the document is moved onto the contact glass 32 in a case in which a document is set on the contact glass 32, or the scanner 300 immediately starts driving in a case in which a document is set on the automatic document feeder 400, so that a first traveling body 33 and a second traveling body 34 start traveling. The first traveling body 33 directs light emitted from a light source to the document. A mirror carried by the second traveling body 34 reflects light reflected from the document toward a reading sensor 36 through an imaging lens 35. Thus, the document is read and converted into image information of black, magenta, cyan, and yellow.

The irradiator 21 forms an electrostatic latent image of each color on each photoconductor drum 10Y, 10C, 10M, or 10K based on image information of each color.

Each electrostatic latent image is developed into a toner image with the developer of each color supplied from each image forming unit 18. The toner images are successively transferred onto the intermediate transfer belt 50 that is rotating by the rollers 14, 15, and 16 in an overlapping manner. Thus, a composite toner image is formed on the intermediate transfer belt 50.

At the same time, in the sheet feed table 200, one of sheet feed rollers 142 starts rotating to feed recording sheets from one of sheet feed cassettes 144 in a sheet bank 143. One of separation rollers 145 separates the sheets one by one and feeds them to a sheet feed path 146. Feed rollers 147 feed each sheet to a sheet feed path 148 in the copier main body 150. The sheet is stopped by striking a registration roller 49. Alternatively, recording sheets may be fed from a manual feed tray 54. In this case, a separation roller 58 separates the sheets one by one and feeds them to a manual sheet feed path 53. The sheet is stopped by striking the registration roller 49. The registration roller 49 is generally grounded. Alternatively, the registration roller 49 may be applied with a bias for the purpose of removing paper powders from the sheet.

The registration roller 49 starts rotating in synchronization with an entry of the composite toner image formed on the intermediate transfer belt 50 to between the intermediate transfer belt 50 and the transfer device 22, so that the recording sheet is fed thereto and the composite toner image can be transferred onto the recording sheet.

The recording sheet having the composite toner image thereon is fed from the transfer device 22 to the fixing device 25. In the fixing device 25, the composite toner image is heated and pressurized by the fixing belt 26 and the pressing roller 27 and thereby fixed on the recording sheet. A switch claw 55 switches sheet feed paths so that the recording sheet is ejected by an ejection roller 56 and stacked on a sheet ejection tray 57.

Alternatively, the switch claw 55 may switch sheet feed paths so that the sheet is introduced into the sheet reversing device 28 and gets reversed. The sheet is then introduced to the transfer position again so that another image is recorded on the back side of the sheet. Thereafter, the sheet is ejected by the ejection roller 56 and stacked on the sheet ejection tray 57.

Residual toner particles remaining on the intermediate transfer belt 50 after the composite image has been transferred are removed by the cleaner 17.

Toner Storage Unit

In the present disclosure, the toner storage unit refers to a combination of a unit having a function of storing toner and the above toner stored in the unit. The toner storage unit may be in the form of, for example, a toner storage container, a developing device, or a process cartridge.

In the present disclosure, the toner storage container refers to a container storing the toner.

The developing device refers to a device storing the toner and having a developing unit configured to develop an electrostatic latent image into a toner image with the toner.

The process cartridge refers to a combined body of an image bearer with a developing unit storing the toner, detachably mountable on an image forming apparatus. The process cartridge may further include at least one of a charger, an irradiator, and a cleaner.

As the toner storage unit is mounted on an image forming apparatus, images are formed with the above toner while maintaining stable transferability onto a paper sheet having large surface unevenness even after a long-term use regardless of the hygrothermal environment.

Figure 11:
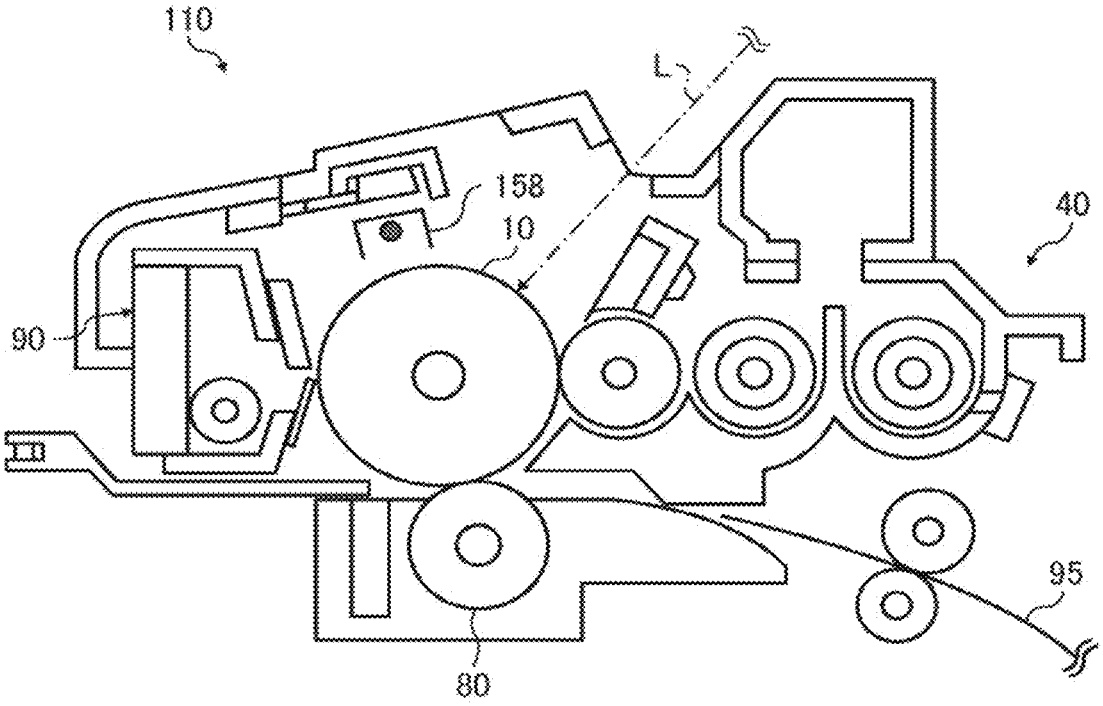
FIG. 11 is a schematic view of a process cartridge in accordance with some embodiments of the present invention.

FIG. 11 is a schematic view of a process cartridge in accordance with some embodiments of the present invention. A process cartridge 110 includes a photoconductor drum 10, a corona charger 158, a developing device 40, a transfer roller 80, and a cleaner 90.

EXAMPLES

The present invention is described in detail with reference to the Examples but is not limited to the following Examples. In the descriptions in the following examples, "parts" represents mass ratios in parts and "%" represents "% by mass", unless otherwise specified. The Examples presented below are prophetic.

Synthesis of Ketimine 1

In a reaction vessel equipped with a stirrer and a thermometer, 170 parts of isophoronediamine and 75 parts of methyl ethyl ketone were contained and reacted at 50° C. for 5 hours. Thus, a ketimine 1 was prepared. The ketimine 1 had an amine value of 418 mgKOH/g.

Synthesis of Amorphous Polyester A

A reaction vessel equipped with a condenser, a stirrer, and a nitrogen inlet tube was charged with 3-methyl-1,5-pentanediol, adipic acid, and trimellitic anhydride. The molar ratio of hydroxyl groups to carboxyl groups was 1.5. The content rate of trimellitic anhydride in all the monomers was 1% by mol. Furthermore, 1,000 ppm of titanium tetraisopropoxide, based on all the monomers, was added to the vessel. The temperature was raised to 200° C. over a period of about 4 hours and thereafter raised to 230° C. over a period of 2 hours. The vessel contents were reacted until water did not outflow and further reacted for 5 hours under reduced pressures of from 10 to 15 mmHg. Thus, an amorphous polyester having hydroxyl group was prepared.

A reaction vessel equipped with a condenser, a stirrer, and a nitrogen inlet tube was charged with the amorphous polyester having hydroxyl group and isophorone diisocyanate. The molar ratio of isocyanate groups to hydroxyl groups was 2.0. After being diluted with ethyl acetate, the vessel contents were reacted at 100° C. for 5 hours. Thus, a 50% ethyl acetate solution of an amorphous polyester prepolymer A was prepared.

In a reaction vessel equipped with a heater, a stirrer, and a nitrogen inlet tube, the 50% ethyl acetate solution of the amorphous polyester prepolymer A was stirred and thereafter the ketimine 1 was dropped therein. The molar ratio of amino groups to isocyanate groups was 1. The vessel contents were stirred at 45° C. for 10 hours and thereafter dried at 50° C. under reduced pressures until the residual amount of ethyl acetate became 100 ppm or less. Thus, an amorphous polyester A was prepared. The amorphous polyester A had a glass transition temperature of −55° C. and a weight average molecular weight of 130,000.

Synthesis of Amorphous Polyester B

A reaction vessel equipped with a nitrogen inlet tube, a dewatering tube, a stirrer, and a thermocouple was charged with ethylene oxide 2 mol adduct of bisphenol A (hereinafter "BisA-EO"), propylene oxide 3 mol adduct of bisphenol A (hereinafter "BisA-PO"), terephthalic acid, and adipic acid. The molar ratio of BisA-EO to BisA-PO was 40/60. The molar ratio of terephthalic acid to adipic acid was 93/7. The molar ratio of hydroxyl groups to carboxyl groups was 1.2. Furthermore, 500 ppm of titanium tetraisopropoxide, based on all the monomers, was added to the vessel. The vessel contents were reacted at 230° C. for 8 hours and further reacted under reduced pressures of from 10 to 15 mmHg for 4 hours. After adding 1% by mol of trimellitic anhydride, based on all the monomers, to the vessel, the vessel contents were reacted at 180° C. for 3 hours. Thus, an amorphous polyester B was prepared. The amorphous polyester B had a glass transition temperature of 67° C. and a weight average molecular weight of 10,000.

Synthesis of Crystalline Polyester C

A reaction vessel equipped with a nitrogen inlet tube, a dewatering tube, a stirrer, and a thermocouple was charged with sebacic acid and 1,6-hexanediol. The molar ratio of hydroxyl groups to carboxyl groups was 0.9. Furthermore, 500 ppm of titanium tetraisopropoxide, based on all the monomers, was added to the vessel. The vessel contents were reacted at 180° C. for 10 hours and further reacted at 200° C. for 3 hours. The vessel contents were further reacted under a reduced pressure of 8.3 kPa for 2 hours. Thus, a crystalline polyester C was prepared. The crystalline polyester C had a melting point of 67° C. and a weight average molecular weight of 25,000.

The above-described melting points, glass transition temperatures, and weight average molecular weights were measured as follows. Measurement of Melting Point and Glass Transition Temperature The melting points and glass transition temperatures were measured with a differential scanning calorimeter Q-200 (available from TA Instruments) in the following manner. First, about 5.0 mg of a sample was put in an aluminum sample container. The sample container was put on a holder unit and set in an electric furnace. The temperature was raised from −80° C. to 150° C. at a rate of 10° C./min under nitrogen atmosphere.

The obtained DSC curve was analyzed with an analysis program installed in the differential scanning calorimeter to determine the glass transition temperature of the sample.

The obtained DSC curve was further analyzed with an analysis program installed in the differential scanning calorimeter to determine the endothermic peak-top temperature as the melting point of the sample.

Measurement of Weight Average Molecular Weight

Weight average molecular weight was measured with a GPC (gel permeation chromatography) instrument HLC-8220GPC (available from Tosoh Corporation) equipped with triple columns TSKgel SuperHZM-H 15 cm (available from Tosoh Corporation). The columns were stabilized in a heat chamber at 40° C. In the measurement, tetrahydrofuran (THF) was allowed to flow in the columns at a flow rate of 1 mL/min, and 50-200 μL of a 0.05-0.6% THF solution of a sample was injected therein. The weight average molecular weight of the sample was determined by comparing the molecular weight distribution of the sample with a calibration curve compiled with several types of monodisperse polystyrene standard samples that shows the relation between the logarithmic values of molecular weights and the number of counts.

The polystyrene standard samples were those having weight average molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, respectively (available from Pressure Chemical Company or Tosoh Corporation).

As the detector, a refractive index (RI) detector was used.

Preparation of Hydrophobic Silica A

Octamethylcyclotetrasiloxane, serving as a silicon compound, was vaporized by heat and mixed with oxygen gas and nitrogen gas. The mixture gas was introduced into the central pipe of a concentric triplex burner. A mixture gas of hydrogen and nitrogen was introduced into the second annular pipe disposed on the outer periphery of the central pipe. Further, the air was introduced into the third annular pipe disposed on the outer periphery of the second annular pipe. By combusting these gases, silica particles were prepared through a gas phase process (hereinafter "gas-phase-process silica particles"). The silica particles were collected with a metallic filter. Manufacturing conditions are presented in Table 1.

In Table 1, "nitrogen supply ratio" refers to a total amount of nitrogen used.

Hydrophobizing Treatment

In a reaction vessel, 5 parts of water and 20 parts of hexamethyldisilazane were sprayed to 100 parts of the gas-phase-process silica particles under nitrogen atmosphere. The reacted mixture was stirred at 280° C. for 1 hour under nitrogen gas flow, followed by cooling. Thus, a hydrophobic silica was prepared.

Pulverization and Classification Treatment

The hydrophobic silica was pulverized by a pulverizer COUNTER JET MILL (available from Hosokawa Micron Corporation) and classified by a classifier TURBOPLEX 1000ATP (available from Hosokawa Micron Corporation). The separated coarse particles were continuously and circulatingly introduced to the JET MILL via pipings so as to be pulverized and classified again. Thus, a hydrophobic silica A was prepared.

Preparation of Hydrophobic Silica B

The procedure for preparing the hydrophobic silica A was repeated except for changing the manufacturing conditions according to Table 1. Thus, a hydrophobic silica B was prepared.

Preparation of Hydrophobic Silica C

The procedure for preparing the hydrophobic silica A was repeated except for changing the manufacturing conditions according to Table 1. Thus, a hydrophobic silica C was prepared.

Preparation of Hydrophobic Silica D

The procedure for preparing the hydrophobic silica A was repeated except for changing the manufacturing conditions according to Table 1. Thus, a hydrophobic silica D was prepared.

Preparation of Hydrophobic Silica E

The procedure for preparing the hydrophobic silica A was repeated except for changing the manufacturing conditions according to Table 1. Thus, a hydrophobic silica E was prepared.

Properties of the hydrophobic silicas A to E are presented in Table 1. Number average particle diameter and the gradient in Rosin-Rammler diagram were measured as follows.

Measurement of Number Average Particle Diameter

A SEM image of each hydrophobic silica was obtained with a field emission scanning electron microscope MERLIN (available from SIT Nanotechnology Inc.) and analyzed to measure the number average particle diameter. Specifically, first, each hydrophobic silica was dispersed in tetrahydrofuran and thereafter fixedly dried on a substrate by removing the solvent (i.e. tetrahydrofuran). The dried sample was observed with the SEM to obtain an image. In the image, the longest length of each secondary particle was measured. The number of measured particles was 200. The number average particle diameter was determined by averaging the measured values. The measurement conditions of the SEM were as follows.

Measurement Conditions of SEM

Acceleration Voltage: 2.0 kV

WD (Working Distance): 10.0 mm

Observation Magnification: 50,000 times

Measurement of Gradient n in Rosin-Rammler Diagram

A Rosin-Rammler diagram was created from the particle diameter distribution obtained in measuring the number average particle diameter by measuring the longest length of each particle. The gradient n was determined by obtaining a straight line by a least-square method within a cumulative volume fraction range of from 15% to 85% and measuring the gradient of the straight line.

TABLE 1

| | | Types | A | B | C | D | E |
|---|---|---|---|---|---|---|---|
| Hydrophobic Silica | Manufacturing Conditions | Silicon Compound Supply Ratio (mol) | 1 | 1 | 1 | 1 | 1 |
| | | Hydrogen Supply Ratio (mol) | 30 | 20 | 20 | 25 | 15 |
| | | Oxygen Supply Ratio (mol) | 45 | 30 | 35 | 40 | 25 |
| | | Nitrogen Supply Ratio (mol) | 15 | 5 | 5 | 45 | 20 |
| | Properties | Number Average Particle Diameter (μm) | 0.04 | 0.08 | 0.06 | 0.05 | 0.11 |
| | | Gradient n in Rosin-Rammler Diagram | 1.4 | 1.2 | 1.0 | 1.8 | 1.5 |

Example 1

Preparation of Master Batch 1

First, 1,200 parts of water, 500 parts of a carbon black (PRINTEX 35 available from Degussa, having a DBP oil absorption of 42 mL/100 mg and a pH of 9.5), and 500 parts of the amorphous polyester B were mixed with a HENSCHEL MIXER (available from NIPPON COKE & ENGINEERING CO., LTD.). The mixture was kneaded with a double roll at 150° C. for 30 minutes, thereafter rolled to cool, and pulverized with a pulverizer. Thus, a master batch 1 was prepared.

Synthesis of Wax Dispersing Agent 1

In an autoclave equipped with a thermometer and a stirrer, 100 parts of a polyethylene wax (SANWAX 151P available from Sanyo Chemical Industries, Ltd., having a melting point of 108° C. and a weight average molecular weight of 1,000) was dissolved in 480 parts of xylene. The air in the autoclave was thereafter replaced with nitrogen gas. A mixture liquid of 805 parts of styrene, 50 parts of acrylonitrile, 45 parts of butyl acrylate, 36 parts of di-t-butyl peroxide, and 100 parts of xylene was dropped in the autoclave over a period of 3 hours to cause a polymerization. The temperature was kept at 170° C. for 30 minutes. By removing the solvent, a wax dispersing agent 1 was obtained. The wax dispersing agent 1 had a glass transition temperature of 65° C. and a weight average molecular weight of 18,000.

Preparation of Wax Dispersion Liquid 1

A vessel equipped with a stirrer and a thermometer was charged with 300 parts of a paraffin wax (HNP-9 available from NIPPON SEIRO CO., LTD., having a melting point of 75° C.), 150 parts of the wax dispersing agent 1, and 1,800 parts of ethyl acetate. The vessel contents were heated to 80° C., kept for 5 hours, and cooled to 30° C. over a period of 1 hour, while being stirred. The vessel contents were thereafter subjected to a dispersion treatment using a bead mill (ULTRAVISCOMILL available from Aimex Co., Ltd.) filled with 80% by volume of zirconia beads having a diameter of 0.5 mm. This operation was repeated 3 times (3 passes). Thus, a wax dispersion liquid 1 was prepared. In the dispersion treatment, the liquid feeding speed was 1 kg/hour and the disc peripheral speed was 6 m/sec.

Preparation of Crystalline Polyester Dispersion Liquid 1

A vessel equipped with a stirrer and a thermometer was charged with 308 parts of the crystalline polyester C and 1,900 parts of ethyl acetate. The vessel contents were heated to 80° C., kept for 5 hours, and cooled to 30° C. over a period of 1 hour, while being stirred. The vessel contents were thereafter subjected to a dispersion treatment using a bead mill (ULTRAVISCOMILL available from Aimex Co., Ltd.) filled with 80% by volume of zirconia beads having a diameter of 0.5 mm. This operation was repeated 3 times (3 passes). Thus, a crystalline polyester dispersion liquid 1 was prepared. In the dispersion treatment, the liquid feeding speed was 1 kg/hour and the disc peripheral speed was 6 m/sec.

Preparation of Oil Phase 1

In a vessel, the wax dispersion liquid 1, the 50% ethyl acetate solution of the amorphous polyester prepolymer A, the amorphous polyester B, the master batch 1, and ethyl acetate were mixed, according to the component ratio described in Table 2, with a TK HOMOMIXER (available from PRIMIX Corporation) at a revolution of 7,000 rpm for 60 minutes. Thus, an oil phase 1 was prepared.

Synthesis of Vinyl Resin Dispersion Liquid 1

In a reaction vessel equipped with a stirrer and a thermometer, 683 parts of water, 11 parts of a sodium salt of sulfate of ethylene oxide adduct of methacrylic acid (ELEMINOL RS-30 available from Sanyo Chemical Industries, Ltd.), 138 parts of styrene, 138 parts of methacrylic acid, and 1 part of ammonium persulfate were stirred at a revolution of 400 rpm for 15 minutes. Thus, a white emulsion was obtained. Next, the emulsion was heated to 75° C. and reacted for 5 hours. After 30 parts of a 1% aqueous solution of ammonium persulfate was added thereto, the emulsion was aged at 75° C. for 5 hours. Thus, a vinyl resin dispersion liquid 1 was prepared. The vinyl resin dispersion liquid 1 had a volume average particle diameter of 0.14 μm.

The volume average particle diameter of the vinyl resin dispersion liquid 1 was measured by a laser diffraction particle size distribution analyzer LA-920 (from Horiba, Ltd.).

Preparation of Aqueous Phase 1

An aqueous phase 1 was prepared by stir-mixing 810 parts of pure water, 83 parts of the vinyl resin dispersion liquid 1, 37 parts of a 48.5% aqueous solution of sodium dodecyl diphenyl ether disulfonate (ELEMINOL MON-7 available from Sanyo Chemical Industries, Ltd.), 180 parts of sodium sulfate, and 90 parts of ethyl acetate. The aqueous phase 1 was a milky white liquid.

Emulsification and Solvent Removal

In the vessel containing the oil phase 1, 0.2 parts of the ketimine 1 and 1,200 parts of the aqueous phase 1 were added and mixed with a TK HOMOMIXER at a revolution of 13,000 rpm for 20 minutes. Thus, an emulsion slurry 1 was prepared. The emulsion slurry 1 was contained in a vessel equipped with a stirrer and a thermometer and subjected to solvent removal at 30° C. for 8 hours and subsequently to aging at 45° C. for 4 hours. Thus, a dispersion slurry 1 was prepared.

It is to be noted that the amorphous polyester A was produced in the process of forming mother particles.

Washing/Heating/Drying

First, 100 parts of the dispersion slurry 1 was filtered under reduced pressures. Next, 100 parts of ion-exchange water was added to the filter cake and mixed therewith using a TK HOMOMIXER at a revolution of 12,000 rpm for 10 minutes, followed by filtration. (This process is hereinafter referred to as "washing process (1)"). Further, 100 parts of a 10% aqueous solution of sodium hydroxide was added to the filter cake and mixed therewith using a TK HOMOMIXER at a revolution of 12,000 rpm for 30 minutes, followed by filtration under reduced pressures. (This process is hereinafter referred to as "washing process (2)"). Next, 100 parts of a 10% aqueous solution of hydrochloric acid was added to the filter cake and mixed therewith using a TK HOMOMIXER at a revolution of 12,000 rpm for 10 minutes, followed by filtration. (This process is hereinafter referred to as "washing process (3)"). Further, 300 parts of ion-exchange water was added to the filter cake and mixed therewith using a TK HOMOMIXER at a revolution of 12,000 rpm for 10 minutes, followed by filtration. (This process is hereinafter referred to as "washing process (4)"). The series of washing processes (1) to (4) was repeated twice.

Further, 100 parts of ion-exchange water was added to the filter cake and mixed therewith using a TK HOMOMIXER at a revolution of 12,000 rpm for 10 minutes. The filter cake was heated to 50° C. for 4 hours, followed by filtration.

The filter cake was dried by a circulating air dryer at 45° C. for 48 hours and sieved with a mesh having an opening of 75 μm. Thus, a mother particle 1 was prepared.

Addition of External Additive Particles

A toner 1 was prepared by mixing 100 parts of the mother particle 1, 2.0 parts of the hydrophobic silica A, and 0.5 parts of a hydrophobic titanium oxide MT-150IB (available from Tayca Corporation) having an average primary particle diameter of 20 nm.

Example 2

A toner 2 was prepared in the same manner as in Example 1 except for replacing the hydrophobic silica A with a hydrophobic silica B.

Example 3

A toner 3 was prepared in the same manner as in Example 1 except for replacing the hydrophobic silica A with a hydrophobic silica C.

Example 4

A toner 4 was prepared in the same manner as in Example 1 except for changing the oil phase component ratio according to Table 2 and replacing the hydrophobic silica A with a hydrophobic silica C.

Comparative Example 1

A toner 5 was prepared in the same manner as in Example 1 except for changing the contents of water and sodium sulfate in the aqueous phase to 870 parts and 120 parts, respectively.

Comparative Example 2

A toner 6 was prepared in the same manner as in Example 1 except for changing the contents of water and sodium sulfate in the aqueous phase to 990 parts and zero, respectively.

Comparative Example 3

A toner 7 was prepared in the same manner as in Example 1 except for replacing the hydrophobic silica A with a hydrophobic silica D.

Comparative Example 4

A toner 8 was prepared in the same manner as in Example 1 except for replacing the hydrophobic silica A with a hydrophobic silica E.

Measurements and Evaluations

Measurement of Volume Average Particle Diameter

Volume average particle diameter of each toner was measured with a COULTER MULTISIZER II in the following manner.

First, 0.1 to 5 mL of a surfactant (preferably a polyoxyethylene alkyl ether (i.e., a nonionic surfactant)), as a dispersant, was added to 100 to 150 ml of an electrolyte solution. Here, the electrolyte solution is a 1% by mass NaCl aqueous solution prepared with the first grade sodium chloride, such as ISOTON-II (available from Beckman Coulter, Inc.). Further, 2 to 20 mg of a sample was added thereto. The electrolyte solution, in which the sample was suspended, was subjected to a dispersion treatment with an ultrasonic disperser for about 1 to 3 minutes. The electrolyte solution was thereafter subjected to a measurement of particle diameter and number of toner particles to determine volume average particle diameter with the above instrument using a 100-μm aperture.

Thirteen channels with the following ranges were used for the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Namely, particles having a particle diameter not less than 2.00 μm and less than 40.30 μm were measured.

Measurement of Average Circularity

Average circularity of each toner was measured with a wet flow particle image analyzer FPIA-2100 and an analysis software program FPIA-2100 Data Processing Program for FPIA version 00-10 (both available from Sysmex Corporation) in the following manner. First, in a 100-ml glass beaker, 0.1 to 0.5 mL of a 10% aqueous solution of an alkylbenzene sulfonate (NEOGEN SC-A available from Dai-ichi Kogyo Seiyaku Co., Ltd.) and 0.1 to 0.5 g of each toner were mixed with a micro spatula. Further, 80 ml of ion-exchange water was added to the beaker. The resulting mixture was dispersed with an ultrasonic disperser UH-50 (available from SMT Co., Ltd.) at 20 kHz and 50 W/10 $cm^3$ for 1 minute, additionally 5 minutes in total, to prepare a measuring sample. An average circularity among particles having a circle-equivalent diameter of 0.60 μm or more and less than 159.21 μm was measured using this measuring sample containing 4,000 to 8000 particles per $10^{-3}$ $cm^3$.

Measurement of Sd, St, and Sd/St

Sd, St, and Sd/St were determined by analyzing a SEM image of each toner obtained with a field emission scanning electron microscope MERLIN (available from SII Nanotechnology Inc.) in the following manner.

First, a secondary electron image of the toner was obtained. In the SEM observation, a conductive tape was used as the substrate so that the toner could appear brighter than the substrate. Brightness and contrast were so selected that neither black dense portion nor white sparse portion appeared in the whole image. The field of view of the screen was adjusted so that only one whole toner particle was present therein. The number of pixels in the one whole toner particle was set to 800,000 pixels or more. The obtained image was read by an image editing and processing software program GIMP for Windows and visually observed to fill portions other than the toner particle with black (i.e., the luminance value of the portions was made zero).

The processed image was further read by an image processing software program ImageJ and a histogram of luminance values was written out to select a threshold for binarization by a discriminant analysis method (i.e., Otsu's binarization method). Binarization of the image was performed by ImageJ using the selected threshold, so that projected portions (having a luminance value of 255) and recessed portions (having a luminance value of 0) of the toner particle were discriminated from each other. A correspondence table of pixel position and luminance value was written out and luminance values were mapped to a spread sheet software program Microsoft Excel.

Next, pixels which are enclosed by a 0.2-μm concentric square all part of which was discriminated as a recessed portion (having a luminance value of 0) were all identified, and the color of the identified pixels was changed to blue. Among multiple groups formed of the continuous pixels, the largest group was identified as the recessed portion D. St was determined by counting the number of pixels in the whole toner particle. Sd was determined by counting the number of the blue-colored pixels. Sd/St was determined from these values.

In Table 2, the average values of Sd and St were those among 50 toner particles.

The measurement conditions of the SEM were as follows.

Measurement Conditions of SEM

Acceleration Voltage: 2.0 kV

WD (Working Distance): 10.0 mm

Measurement of Frequency of Toner Particles Having Sd/St of 5%-50%

A secondary electron image of each toner was obtained with a field emission scanning electron microscope MERLIN (available from SII Nanotechnology Inc.) by adjusting the field of view of the screen such that about 50 toner particles were present therein. Subsequently, a magnified secondary electron image was obtained for each toner particle to determine Sd, St, and Sd/St of each toner particle. The frequency was determined from the ratio of the number of particles having a ratio Sd/St of from 5% to 50% to the number of all the particles. In addition, the average values of Sd and St for the particles having a ratio Sd/St of from 5% to 50% were calculated.

Measurement of External Additive Coverage Rate Ca

The above-obtained original image of each toner particle was read by GIMP for Windows and portions corresponding to the external additive particles in the largest recessed portion D were filled with white (i.e., the luminance value of the portions was made 255). A correspondence table of pixel position and luminance value of this image was written out by ImageJ and overwritten on the mapping sheet of Microsoft Excel on which St, Sd, and Sd/St had been determined. The number of pixels having a luminance value of 255 in the largest recessed portion D (i.e., blue pixels) was counted and identified as Sa. The external additive coverage rate Ca was determined from the following formula.

$$Ca=Sa/Sd$$

Measurement of High-Temperature High-Humidity Transferability

Toners prepared in the Examples and Comparative Examples were each mixed with a carrier exclusive for IMAGIO MF3550 (available from Ricoh Co., Ltd., a black-and-white copier employing two-component developing method) such that the toner toner concentration became 5% by mass, thus preparing two-component developers. Each developer was set in the IMAGIO MF3550 and subjected to evaluation of transfer rate. The copying conditions were as follows.

Copying Conditions

Hygrothermal environment: 35° C., 80%

Copying speed: 35 CPM (copies per minute)

Linear speed of photoconductor: 180 mm/s

Pixel density: 400 dpi

Surface potential of photoconductor: −150 V to −950 V

Developing voltage: −550 V

The transfer rate was measured as follows. After an image chart having an image area rate of 20% had been transferred from the photoconductor to a paper sheet and immediately before the photoconductor was cleaned, residual toner particles remaining on the photoconductor were transferred onto a white paper sheet via a piece of SCOTCH TAPE (available from Sumitomo 3M Limited). A density of the toner particles on the sheet was measured by a Macbeth reflection densitometer RD514 and evaluated according to the following criteria.

Evaluation Criteria

A: The difference from the blank density was less than 0.005.

B: The difference from the blank density was from 0.005 to 0.010.

C: The difference from the blank density was in excess of 0.010.

The initial evaluation for the transfer rate was performed using plain paper TYPE 6000 (product of Ricoh Co., Ltd.)

and embossed paper LEATHAC 66 (product of Tokushu Tokai Paper Co., Ltd.) and thereafter a continuous copying on 100,000 sheets of plain paper TYPE 6000 (product of Ricoh Co., Ltd.) was performed. After termination of the continuous copying, the transfer rate was evaluated again using the plain paper and the embossed paper.

TABLE 2

| | | | Example 1 Toner 1 | Example 2 Toner 2 | Example 3 Toner 3 | Example 4 Toner 4 | Comparative Example 1 Toner 5 | Comparative Example 2 Toner 6 | Comparative Example 3 Toner 7 | Comparative Example 4 Toner 8 |
|---|---|---|---|---|---|---|---|---|---|---|
| Oil Phase Composition | | Amorphous Polyester A (parts) | 15 | 15 | 15 | 15 | 15 | 15 | 15 | 15 |
| | | Amorphous Polyester B (parts) | 73 | 73 | 73 | 65 | 73 | 73 | 73 | 73 |
| | | Crystalline Polyester C (parts) | 0 | 0 | 0 | 8 | 0 | 0 | 0 | 0 |
| | | Release Agent (parts) | 6 | 6 | 6 | 6 | 6 | 6 | 6 | 6 |
| | | Colorant (parts) | 6 | 6 | 6 | 6 | 6 | 6 | 6 | 6 |
| Aqueous Phase Composition | | Pure Water (parts) | 810 | 810 | 810 | 810 | 870 | 990 | 810 | 810 |
| | | Vinyl Resin Dispersion Liquid (parts) | 83 | 83 | 83 | 83 | 83 | 83 | 83 | 83 |
| | | MON-7 (parts) | 37 | 37 | 37 | 37 | 37 | 37 | 37 | 37 |
| | | Sodium Sulfate (parts) | 180 | 180 | 180 | 180 | 120 | 0 | 180 | 180 |
| | | Ethyl Acetate (parts) | 90 | 90 | 90 | 90 | 90 | 90 | 90 | 90 |
| External Additives | | Mother Particles (parts) | 100 | 100 | 100 | 100 | 100 | 100 | 100 | 100 |
| | | Hydrophobic Silica | A | B | C | C | A | A | D | E |
| | | (Type, parts) | 2.0 | 2.0 | 2.0 | 2.0 | 2.0 | 2.0 | 2.0 | 2.0 |
| | | Hydrophobic Titanium Oxide (parts) | 0.5 | 0.5 | 0.5 | 0.5 | 0.5 | 0.5 | 0.5 | 0.5 |
| Toner Properties | | Volume Average Particle Diameter (μm) | 4.87 | 4.87 | 4.87 | 4.79 | 4.79 | 4.79 | 4.79 | 4.79 |
| | | Circularity | 0.96 | 0.96 | 0.96 | 0.97 | 0.97 | 0.97 | 0.97 | 0.97 |
| | | Frequency (%) of toner particles satisfying 5% ≤ Sd/St ≤ 50% | 21 | 23 | 23 | 22 | 12 | 0 | 20 | 20 |
| | | Average of St ($\mu m^2$) among toner particles satisfying 5% ≤ Sd/St ≤ 50% | 36.5 | 36.7 | 36.1 | 36.6 | 36.2 | — | 37.0 | 36.1 |
| | | Average of Sd ($\mu m^2$) among toner particles satisfying 5% ≤ Sd/St ≤ 50% | 2.4 | 2.3 | 2.4 | 2.7 | 1.1 | — | 2.4 | 2.4 |
| | | External Additive Coverage Rate Ca (%) at Recessed Portion D | 33 | 47 | 54 | 52 | 37 | 38 | 24 | 26 |
| Toner Quality | High-temperature | Initial Stage/Plain Paper | A | A | A | A | B | B | B | B |
| | | After Continuous Printing/ Plain Paper | A | A | A | A | C | C | B | B |
| | High-Humidity Transfer-ability | Initial Stage/Embossed Paper | B | B | A | A | C | C | B | B |
| | | After Continuous Printing/ Embossed Paper | B | B | B | A | C | C | C | C |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

toner particles each comprising:

a mother particle comprising a binder resin comprising an amorphous resin and a crystalline resin; and external additive particles covering the mother particle, wherein, in a SEM image of the toner, toner particles having a ratio Sd/St of from 5% to 50% are present at a frequency of 15% or more, where Sd representing an area of a largest recessed portion D of each toner particle and St representing whole area of the toner particle, Sd and St determined from the SEM image magnified and binarized to discriminate recessed portions and projected portions of the toner particle from each other, wherein an external additive coverage rate Ca at the largest recessed portion D is from 30% to 100%, and wherein the external additive particles have a number average particle diameter of from 0.03 to 0.10 μm, and a particle diameter distribution of the external additive particles indicated in a Rosin-Rammler diagram has a gradient of from 0.8 to 1.6.

2. The toner of claim 1, wherein the external additive coverage rate Ca is 50% or more.

3. The toner of claim 1, wherein the amorphous resin is an amorphous polyester resin and the crystalline resin is a crystalline polyester resin.

4. The toner of claim 1, wherein the external additive particles are silica particles.

5. A developer comprising:
the toner of claim 1; and
a carrier.

6. A toner storage unit comprising:
a container; and
the toner of claim 1 stored in the container.

7. An image forming apparatus comprising:
a photoconductor;
a charger to charge the photoconductor;
an irradiator to irradiate the charged photoconductor with light to form an electrostatic latent image thereon; and
a developing device including the toner of claim 1, the developing device configured to develop the electrostatic latent image into a toner image with the toner.

* * * * *